US011401879B2

(12) United States Patent
Itaba et al.

(10) Patent No.: US 11,401,879 B2
(45) Date of Patent: Aug. 2, 2022

(54) FUEL INJECTION CONTROL DEVICE

(71) Applicant: Hitachi Astemo, Ltd., Hitachinaka (JP)

(72) Inventors: Fumihiro Itaba, Hitachinaka (JP); Masahiro Toyohara, Hitachinaka (JP); Osamu Mukaihara, Hitachinaka (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 0 days.

(21) Appl. No.: 17/294,718

(22) PCT Filed: Dec. 4, 2019

(86) PCT No.: PCT/JP2019/047336
§ 371 (c)(1),
(2) Date: May 18, 2021

(87) PCT Pub. No.: WO2020/129631
PCT Pub. Date: Jun. 25, 2020

(65) Prior Publication Data

US 2022/0010747 A1 Jan. 13, 2022

(30) Foreign Application Priority Data

Dec. 19, 2018 (JP) ..... JP2018-236941

(51) Int. Cl.
*F02D 41/20* (2006.01)
*F02D 41/40* (2006.01)
*H01F 7/06* (2006.01)

(52) U.S. Cl.
CPC ..... *F02D 41/20* (2013.01); *F02D 41/401* (2013.01); *H01F 7/064* (2013.01)

(58) Field of Classification Search
CPC ..... F02D 2041/2003; F02D 2041/2055; F02D 2041/2058; F02D 41/20; F02D 41/401
See application file for complete search history.

(56) References Cited

U.S. PATENT DOCUMENTS 6,364,282 B1 * 4/2002 Ausman ..... F02M 57/025 123/446
8,018,216 B2 * 9/2011 Kakehi ..... H02M 3/00 323/284

(Continued)

FOREIGN PATENT DOCUMENTS

JP 2002-531769 A 9/2002
JP 2016-121610 A 7/2016

(Continued)

OTHER PUBLICATIONS

JP2018084240A_Description_20220331_1117 machine translation (Year: 2018).*

(Continued)

*Primary Examiner* — Carl C Staubach
(74) *Attorney, Agent, or Firm* — Crowell & Moring LLP

(57) ABSTRACT

Provided is a fuel injection control device capable of reducing variations in injection amounts of a plurality of fuel injection valves. Thus, the fuel injection control device of the present invention includes a control unit that controls voltages applied to coils of a plurality of fuel injection valves, the coils being adapted for energization. The control unit performs control such that the voltage being applied to the coil is cut off. The control unit changes a timing at which the cutoff of the voltage to the coil of at least one fuel injection valve is started or a timing at which the cutoff of the voltage to the coil of at least one fuel injection valve is ended, based on a valve closing time until closing of the fuel injection valve is completed or a valve opening time until opening of the fuel injection valve is completed.

13 Claims, 15 Drawing Sheets

(56) References Cited

U.S. PATENT DOCUMENTS

| | | | | |
|---|---|---|---|---|
| 9,228,526 | B2 * | 1/2016 | Nishimura | F02D 41/20 |
| 9,388,760 | B2 * | 7/2016 | Katsurahara | F02D 41/30 |
| 9,714,626 | B2 * | 7/2017 | Hatanaka | F02M 63/0017 |
| 10,808,642 | B2 * | 10/2020 | Satake | F02D 41/247 |
| 2014/0366848 | A1 * | 12/2014 | Fujii | F02D 41/402 123/480 |
| 2017/0051696 | A1 * | 2/2017 | Mukaihara | F02D 41/20 |
| 2017/0335787 | A1 | 11/2017 | Aono et al. | |
| 2019/0383179 | A1 * | 12/2019 | Etzler | F02D 41/2403 |
| 2021/0249170 | A1 * | 8/2021 | Katagiri | F02D 41/20 |

FOREIGN PATENT DOCUMENTS

| | | | |
|---|---|---|---|
| JP | 2018-84240 | A | 5/2018 |
| WO | WO 2015/163077 | A1 | 4/2017 |

OTHER PUBLICATIONS

International Search Report (PCT/ISA/210) issued in PCT Application No. PCT/JP2019/047336 dated Apr. 7, 2020 with English translation (four (4) pages).

Japanese-language Written Opinion (PCT/ISA/237) issued in PCT Application No. PCT/JP2019/047336 dated Apr. 7, 2020 (four (4) pages).

* cited by examiner

FUEL INJECTION CONTROL DEVICE

TECHNICAL FIELD

The present invention relates to a fuel injection control device.

BACKGROUND ART

In recent years, an internal combustion engine needs to simultaneously achieve low fuel consumption and high output. As one of means to achieve the low fuel consumption and high output, it is necessary to expand a dynamic range of a fuel injection valve. In order to expand the dynamic range of the fuel injection valve, it is necessary to improve dynamic flow characteristics while securing static flow characteristics of the related art. As a method for improving the dynamic flow characteristics, reduction of a minimum injection amount by half lift control is known.

PTL 1 discloses a control device for an electromagnetic fuel injection valve that reduces a variation in an injection amount of a minimum injection by setting injection amount characteristics in half lift control to approach injection amount characteristic at the time of full lift. In the control device for the electromagnetic fuel injection valve, a lift amount of a valve body is adjusted by applying a boosted voltage at a timing at which energization to the fuel injection valve is started and adjusting a high voltage energization time in which a magnetic attraction force required for a valve opening operation of a valve body is generated and a time in which a relatively small voltage is applied. Accordingly, injection amount characteristics in a half lift region approach injection amount characteristics in a full lift region.

CITATION LIST

Patent Literature

PTL 1: WO2015/163077A

SUMMARY OF INVENTION

Technical Problem

However, the half lift control of the control device for the electromagnetic fuel injection valve disclosed in PTL merely adjusts an application time of the boosted voltage and an application time of the low voltage. Thus, it is possible to improve linearity of the injection amount characteristics in the half lift region, but the variation in the injection amount becomes large especially in a region in which the injection amount increases from the minimum injection amount.

An object of the present invention is to provide a fuel injection control device capable of reducing variations in injection amounts of a plurality of fuel injection valves in consideration of the above problems.

Solution to Problem

In order to solve the above problems and achieve the object of the present invention, a fuel injection control device of the present invention includes a control unit that controls voltages applied to coils of a plurality of fuel injection valves, the coils being adapted for energization. The control unit performs control such that the voltage being applied to the coil is cut off. The control unit changes a timing at which the cutoff of the voltage to the coil of at least one fuel injection valve is started or a timing at which the cutoff of the voltage to the coil of at least one fuel injection valve is ended, based on a valve closing time from when energization to the fuel injection valve is stopped to when closing of the fuel injection valve is completed or a valve opening time from when the energization to the fuel injection valve is started to when opening of the fuel injection valve is completed.

Advantageous Effects of Invention

According to the fuel injection control device having the above configuration, it is possible to reduce the variation in the injection amount of each fuel injection valve.

Other objects, configurations, and effects will be made apparent in the descriptions of the following embodiments.

DESCRIPTION OF EMBODIMENTS

Figure 1:
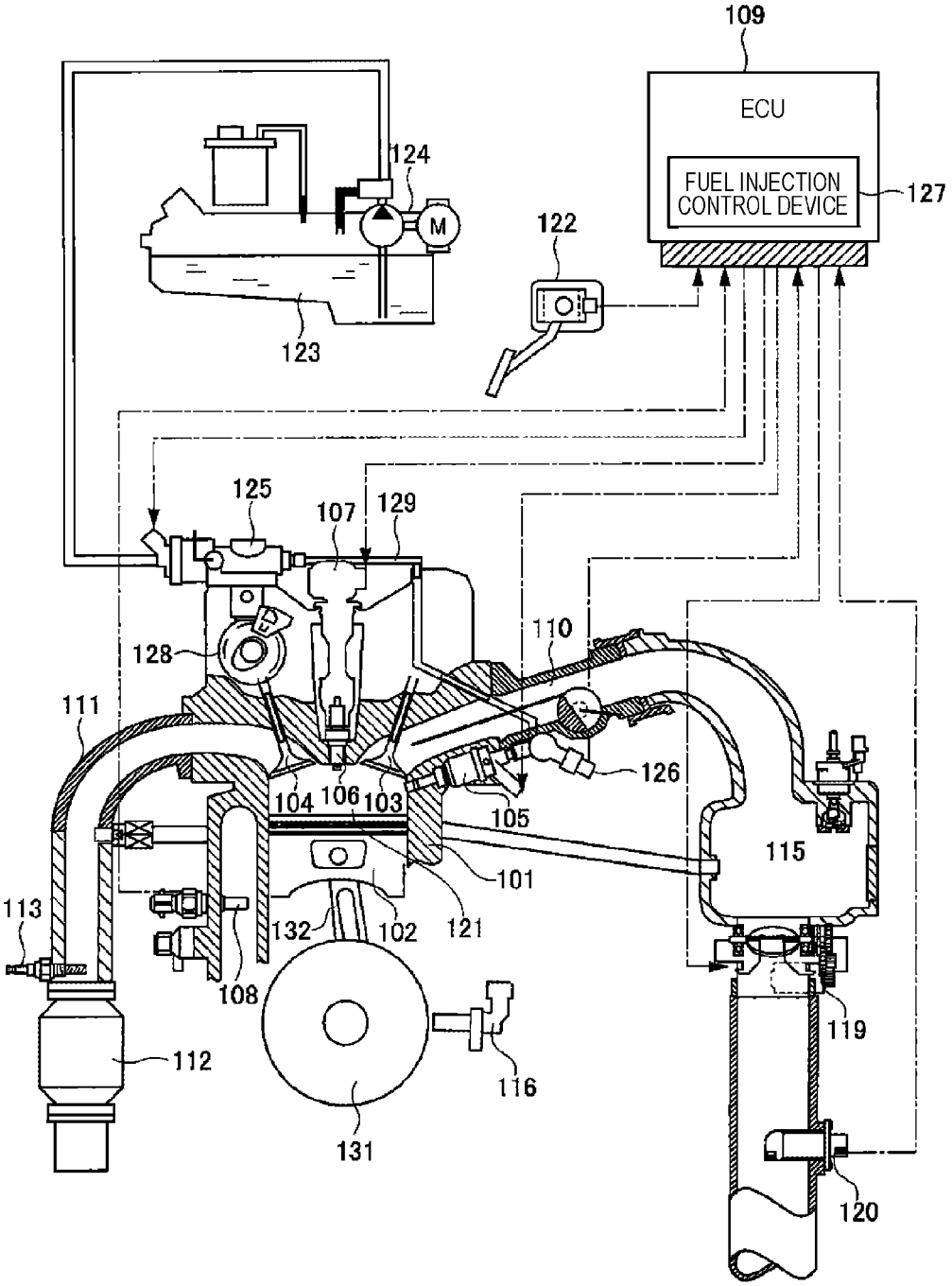
FIG. 1 is an overall configuration diagram showing a basic configuration example of an internal combustion engine equipped with a fuel injection control device according to an embodiment of the present invention.

Hereinafter, a fuel injection control device according to an embodiment of the present invention will be described. The same reference signs are assigned to members common in the drawings.

[Internal Combustion Engine System]

First, a configuration of an internal combustion engine system equipped with the fuel injection control device according to the present embodiment will be described. FIG. 1 is an overall configuration diagram of the internal combustion engine system equipped with the fuel injection control device according to the embodiment.

An internal combustion engine (engine) 101 shown in FIG. 1 is a four-cycle engine in which four strokes of an intake stroke, a compression stroke, a combustion (expansion) stroke, and an exhaust stroke are repeated, and is, for example, a multi-cylinder engine having four cylinders. The number of cylinders of the internal combustion engine 101 is not limited to four, and may be six or eight or more cylinders.

The internal combustion engine 101 includes a piston 102, an intake valve 103, and an exhaust valve 104. Suction air (intake air) to the internal combustion engine 101 passes through an air flow meter (AFM) 120 that detects the amount of inflowing air, and a flow rate is adjusted by a throttle valve 119. The air passed through the throttle valve 119 is sucked into a collector 115, which is a branch portion, and then is supplied to a combustion chamber 121 of each cylinder via an intake pipe 110 and the intake valve 103 provided for each cylinder.

On the other hand, fuel is supplied from a fuel tank 123 to a high-pressure fuel pump 125 by a low-pressure fuel pump 124, and is increased to a pressure required for fuel injection by the high-pressure fuel pump 125. That is, the high-pressure fuel pump 125 moves a plunger provided in the high-pressure fuel pump 125 up and down by a power transmitted from an exhaust cam shaft (not shown) of an exhaust cam 128, and pressurizes (boosts) the fuel in the high-pressure fuel pump 125.

An opening and closing valve driven by a solenoid is provided at a suction port of the high-pressure fuel pump 125, and the solenoid is connected to a fuel injection control device 127 provided in an engine control unit (ECU) 109. The fuel injection control device 127 controls the solenoid based on a control instruction from the ECU 109, and drives the opening and closing valve such that a pressure (fuel pressure) of the fuel discharged from the high-pressure fuel pump 125 becomes a desired pressure.

The fuel boosted by the high-pressure fuel pump 125 is sent to a fuel injection valve 105 via a high-pressure fuel pipe 129. The fuel injection valve 105 injects the fuel directly into the combustion chamber 121 based on an instruction of the fuel injection control device 127. The fuel injection valve 105 is an electromagnetic valve that operates a valve body to inject the fuel by supplying (energizing) a drive current to an electromagnetic coil to be described later.

A fuel pressure sensor 126 that measures the fuel pressure in the high-pressure fuel pipe 129 is provided in the internal combustion engine 101. The ECU 109 sends a control instruction for setting the fuel pressure in the high-pressure fuel pipe 129 to a desired pressure to the fuel injection control device 127 based on a measurement result by the fuel pressure sensor 126. That is, the ECU 109 sets the fuel pressure in the high-pressure fuel pipe 129 to a desired pressure by performing so-called feedback control.

An ignition plug 106, an ignition coil 107, and a water temperature sensor 108 are provided in each combustion chamber 121 of the internal combustion engine 101. The ignition plug 106 exposes an electrode portion in the combustion chamber 121, and ignites an air-fuel mixture in which the intake air and the fuel are mixed in the combustion chamber 121 by electric discharge. The ignition coil 107 creates a high voltage for discharging at the ignition plug 106. The water temperature sensor 108 measures a temperature of a cooling water that cools the cylinder of the internal combustion engine 101.

The ECU 109 performs energization control of the ignition coil 107 and ignition control by the ignition plug 106. The air-fuel mixture of the intake air and the fuel in the combustion chamber 121 is burned by sparks emitted from the ignition plug 106, and the piston 102 is pushed down by this pressure.

Exhaust gas generated by burning is discharged to an exhaust pipe 111 via the exhaust valve 104. A three-way catalyst 112 and an oxygen sensor 113 are provided at the exhaust pipe 111. For example, the three-way catalyst 112 purifies harmful substances such as nitrogen oxides (NOx) contained in the exhaust gas. The oxygen sensor 113 detects an oxygen concentration contained in the exhaust gas and outputs a detection result to the ECU 109. Based on the detection result of the oxygen sensor 113, the ECU 109 performs the feedback control such that a fuel injection amount supplied from the fuel injection valve 105 becomes a target air-fuel ratio.

A crankshaft 131 is connected to the piston 102 via a connecting rod 132. A reciprocating motion of the piston 102 is converted into a rotary motion by the crankshaft 131. A crank angle sensor 116 is attached to the crankshaft 131. The crank angle sensor 116 detects a rotation and a phase of the crankshaft 131, and outputs a detection result to the ECU 109. The ECU 109 can detect a rotational speed of the internal combustion engine 101 based on an output of the crank angle sensor 116.

Signals of the crank angle sensor 116, the air flow meter 120, the oxygen sensor 113, an accelerator opening sensor 122 indicating an opening degree of an accelerator operated by a driver, the fuel pressure sensor 126, and the like are input to the ECU 109.

The ECU 109 calculates a required torque of the internal combustion engine 101 based on the signal supplied from the accelerator opening sensor 122, and determines whether or not the internal combustion engine is in an idle state. The ECU 109 calculates an intake air amount required for the internal combustion engine 101 from the required torque and the like, and outputs an opening signal corresponding to the intake air amount to the throttle valve 119.

The ECU 109 has a rotation speed detection unit that calculates the rotational speed of the internal combustion engine 101 (hereinafter, referred to as an engine speed) based on the signal supplied from the crank angle sensor 116. The ECU 109 has a warm-up determination unit that determines whether or not the three-way catalyst 112 is in a warm-up state from the temperature of the cooling water obtained from the water temperature sensor 108, an elapsed time after the start of the internal combustion engine 101, and the like.

The fuel injection control device 127 calculates a fuel amount corresponding to the intake air amount, and outputs a fuel injection signal corresponding to the fuel amount to the fuel injection valve 105. The fuel injection control device 127 outputs an energization signal to the ignition coil 107 and outputs an ignition signal to the ignition plug 106.

[Configuration of Fuel Injection Control Device]

Next, a configuration of the fuel injection control device 127 shown in FIG. 1 will be described with reference to FIGS. 2 and 3.

Figure 2:
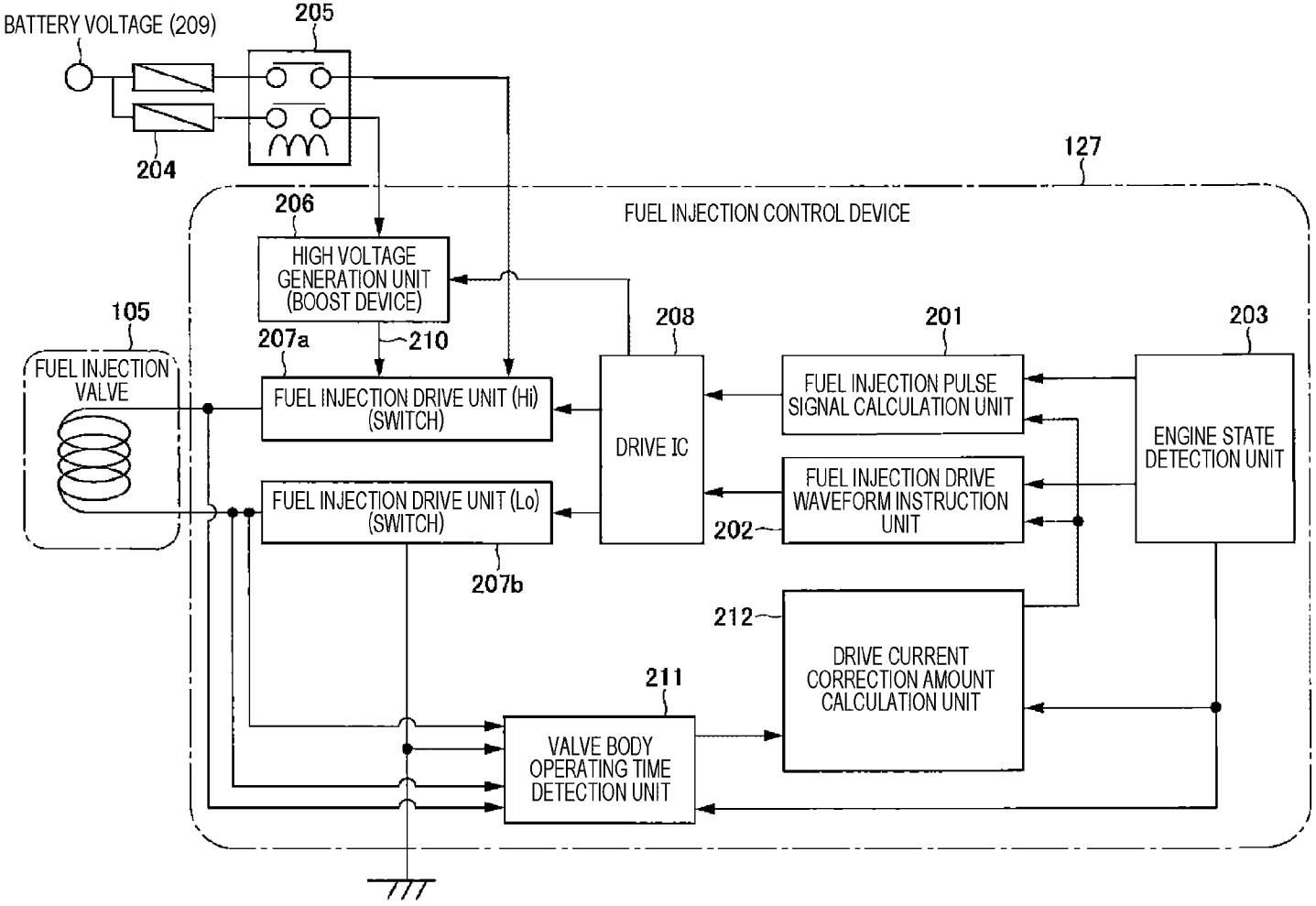
FIG. 2 is a schematic configuration diagram showing the fuel injection control device according to the embodiment of the present invention.

FIG. 2 is a schematic configuration diagram showing the fuel injection control device 127. FIG. 3 is a diagram showing a configuration example of a fuel injection drive unit shown in FIG. 2.

As shown in FIG. 2, the fuel injection control device 127 includes a fuel injection pulse signal calculation unit 201 and a fuel injection drive waveform instruction unit 202 as fuel injection control units, an engine state detection unit 203, and a drive IC 208. The fuel injection control device 127 includes a high voltage generation unit (boost device) 206, fuel injection drive units 207*a* and 207*b*, a valve body operating time detection unit 211, and a drive current correction amount calculation unit 212.

The engine state detection unit 203 collects and provides various kinds of information such as the above-mentioned engine speed, intake air amount, cooling water temperature, and fuel pressure, and a failure state of the internal combustion engine 101. The fuel injection pulse signal calculation unit 201 calculates an injection pulse width that defines a fuel injection period of the fuel injection valve 105 based on various kinds of information obtained from the engine state detection unit 203, and outputs the injection pulse width to the drive IC 208. The fuel injection drive waveform instruction unit 202 calculates an instruction value of the drive current supplied for opening the fuel injection valve 105 and maintaining the valve opening, and outputs the instruction value to the drive IC 208.

A battery voltage 209 is supplied to the high voltage generation unit 206 via a fuse 204 and a relay 205. The high voltage generation unit 206 generates a high power supply voltage 210 required when the electromagnetic solenoid type fuel injection valve 105 is opened based on the battery voltage 209. Hereinafter, the power supply voltage 210 is referred to as a high voltage 210. The fuel injection valve 105 includes two powers of the high voltage 210 for securing a valve opening force of the valve body and the battery voltage 209 for maintaining the valve opening such that the valve body is not closed after the valve is opened.

The fuel injection drive unit 207*a* is provided on an upstream side of the fuel injection valve 105, and supplies the high voltage 210 required for opening the fuel injection valve 105 to the fuel injection valve 105. The fuel injection drive unit 207*a* supplies, to the fuel injection valve 105, the battery voltage 209 required for maintaining an opened state of the fuel injection valve 105 after the fuel injection valve 105 is opened.

Figure 3:
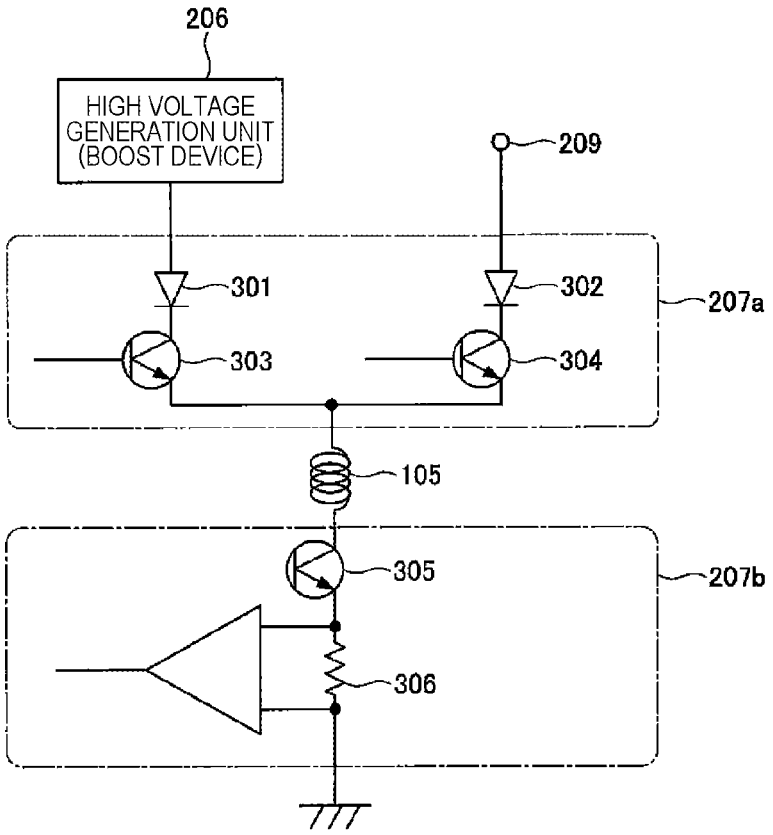
FIG. 3 is a diagram showing a configuration example of the fuel injection drive unit shown in FIG. 2.

As shown in FIG. 3, the fuel injection drive unit 207*a* includes diodes 301 and 302, a high voltage side switching element 303, and a low voltage side switching element 304. The fuel injection drive unit 207*a* supplies the high voltage 210 supplied from the high voltage generation unit 206 to the fuel injection valve 105 by using the high voltage side switching element 303 through the diode 301 provided for preventing current backflow.

The fuel injection drive unit 207*a* supplies the battery voltage 209 supplied via the relay 205 to the fuel injection valve 105 by using the low voltage side switching element 304 through the diode 302 provided for preventing current backflow.

The fuel injection drive unit 207*b* is provided on a downstream side of the fuel injection valve 105, and has a switching element 305 and a shunt resistor 306. The fuel injection drive unit 207*b* applies a power supplied from the fuel injection drive unit 207*a* on the upstream side to the fuel injection valve 105 by turning on the switching element 305. The fuel injection drive unit 207*b* detects a current consumed by the fuel injection valve 105 by the shunt resistor 306.

The drive IC 208 shown in FIG. 2 controls the fuel injection drive units 207*a* and 207*b* based on the injection pulse width calculated by the fuel injection pulse signal calculation unit 201 and a drive current waveform calculated by the fuel injection drive waveform instruction unit 202. That is, the drive IC 208 controls the high voltage 210 and the battery voltage 209 applied to the fuel injection valve 105, and controls the drive current supplied to the fuel injection valve 105.

The valve body operating time detection unit 211 detects a valve body operating time in the fuel injection valve 105 and outputs the valve body operating time to the drive current correction amount calculation unit 212. The drive current correction amount calculation unit 212 calculates a correction amount of the drive current based on the valve body operating time, and outputs the correction amount to the fuel injection pulse signal calculation unit 201 and the fuel injection drive waveform instruction unit 202. The drive current correction amount calculation unit 212 and the fuel injection drive waveform instruction unit 202 show a specific example of a control unit according to the present invention. The detection of the valve body operating time by the valve body operating time detection unit 211 and the calculation of the correction amount of the drive current by the drive current correction amount calculation unit 212 will be described in detail later.

[Configuration of Fuel Injection Valve]

Next, a configuration of the fuel injection valve 105 will be described with reference to FIG. 4.

Figure 4:
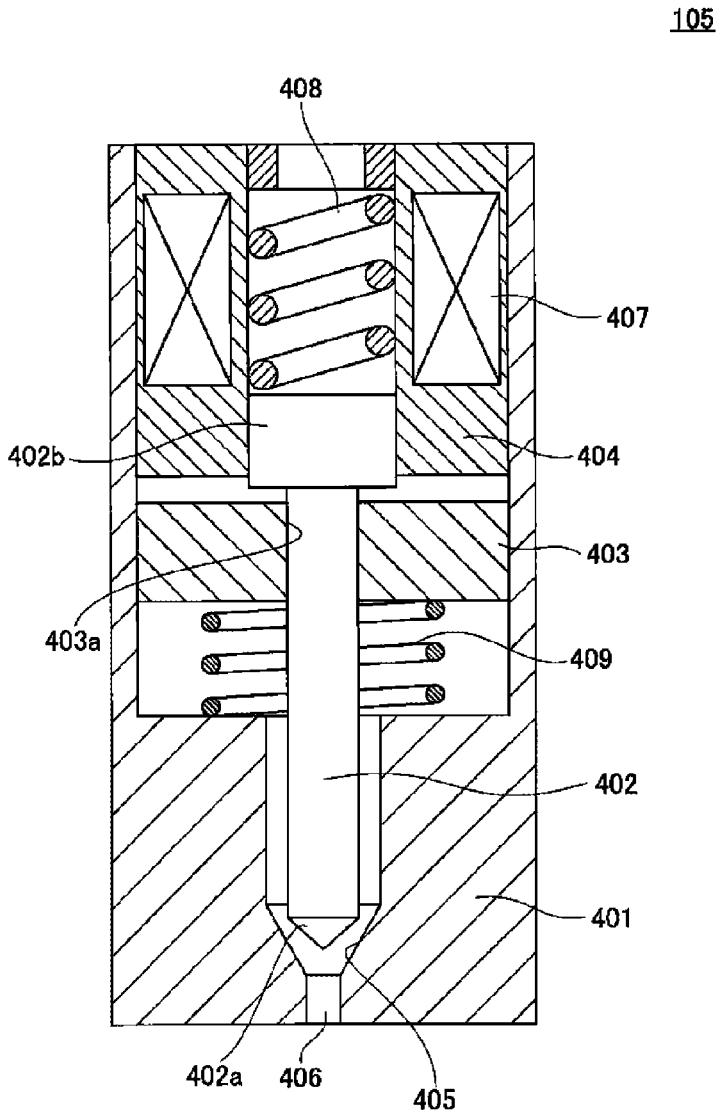
FIG. 4 is a sectional view of a fuel injection valve shown in FIG. 1.

FIG. 4 is a sectional view of the fuel injection valve 105.

The fuel injection valve 105 is an electromagnetic fuel injection valve including a normally closed valve type solenoid valve. The fuel injection valve 105 has a housing 401 forming an outer shell portion, a valve body 402 disposed in the housing 401, a movable core 403, and a fixed core 404. A valve seat 405 and an injection hole 406 that is communicatively connected with the valve seat 405 are formed in the housing 401.

The valve body 402 is formed in a substantially rod shape, and a distal end portion 402*a* which is one end is formed in a substantially conical shape. The distal end portion 402*a* of the valve body 402 faces the valve seat 405 of the housing 401. The fuel injection valve 105 closes when the distal end portion 402*a* of the valve body 402 comes into contact with the valve seat 405, and the fuel is not injected from the injection hole 406. Hereinafter, it is assumed that a direction in which the distal end portion 402*a* of the valve body 402 approaches the valve seat 405 is a valve closing direction and a direction in which the distal end portion 402*a* of the valve body 402 is away from the valve seat 405 is a valve opening direction.

The fixed core 404 is formed in a cylindrical shape and is fixed to an end portion of the housing 401 opposite to the valve seat 405. The other end (rear end) side of the valve body 402 is inserted into a cylindrical hole of the fixed core 404. A solenoid 407 is disposed inside the fixed core 404 so as to travel round the other end (rear end) side of the valve body 402.

A set spring 408 that urges the valve body 402 in the valve closing direction is disposed in the cylindrical hole of the fixed core 404. One end of the set spring 408 abuts on a rear end portion 402*b* which is the other end of the valve body 402, and the other end of the set spring 408 abuts on the housing 401.

The movable core 403 is disposed between the fixed core 404 and the valve seat 405, and has a circular through-hole 403*a* through which the valve body 402 penetrates. The rear end portion 402*b* of the valve body 402 has a diameter larger than the through-hole 403*a* of the movable core 403. Accordingly, the periphery of the through-hole 403*a* in the movable core 403 faces the periphery of the rear end portion 402*b* of the valve body 402.

A zero spring 409 is disposed between the movable core 403 and the housing 401. The zero spring 409 urges the movable core 403 in the valve opening direction. The movable core 403 is disposed in an initial position set between the fixed core 404 and the valve seat 405 by being urged by the zero spring 409.

The inside of the housing 401 is filled with fuel. When a current does not flow through the solenoid 407, the set spring 408 urges the valve body 402 in the valve closing direction, and presses the valve body 402 in the valve closing direction against an urging force of the zero spring 409. Accordingly, the distal end portion 402*a* of the valve body 402 abuts on the valve seat 405 and closes the injection hole 406.

When the current flows through the solenoid 407, a magnetic flux is generated between the fixed core 404 and the movable core 403, and a magnetic attraction force acts on the movable core 403. Accordingly, the movable core 403 is attracted to the fixed core 404 (solenoid 407), and the movable core 403 abuts on the rear end portion 402*b* of the valve body 402. As a result, the valve body 402 moves in the valve opening direction in conjunction with the movable core 403.

When the valve body 402 moves in the valve opening direction, the distal end portion 402*a* of the valve body 402 is separated from the valve seat 405, and the injection hole 406 previously blocked by the valve body 402 is opened. Accordingly, the fuel is injected. After the fuel injection, the movable core 403 returns to the initial position by the balance between the set spring 408 and the zero spring 409.

[Method for Driving Fuel Injection Valve]

Next, a method for driving the fuel injection valve 105 will be described with reference to FIG. 5.

Figure 5:
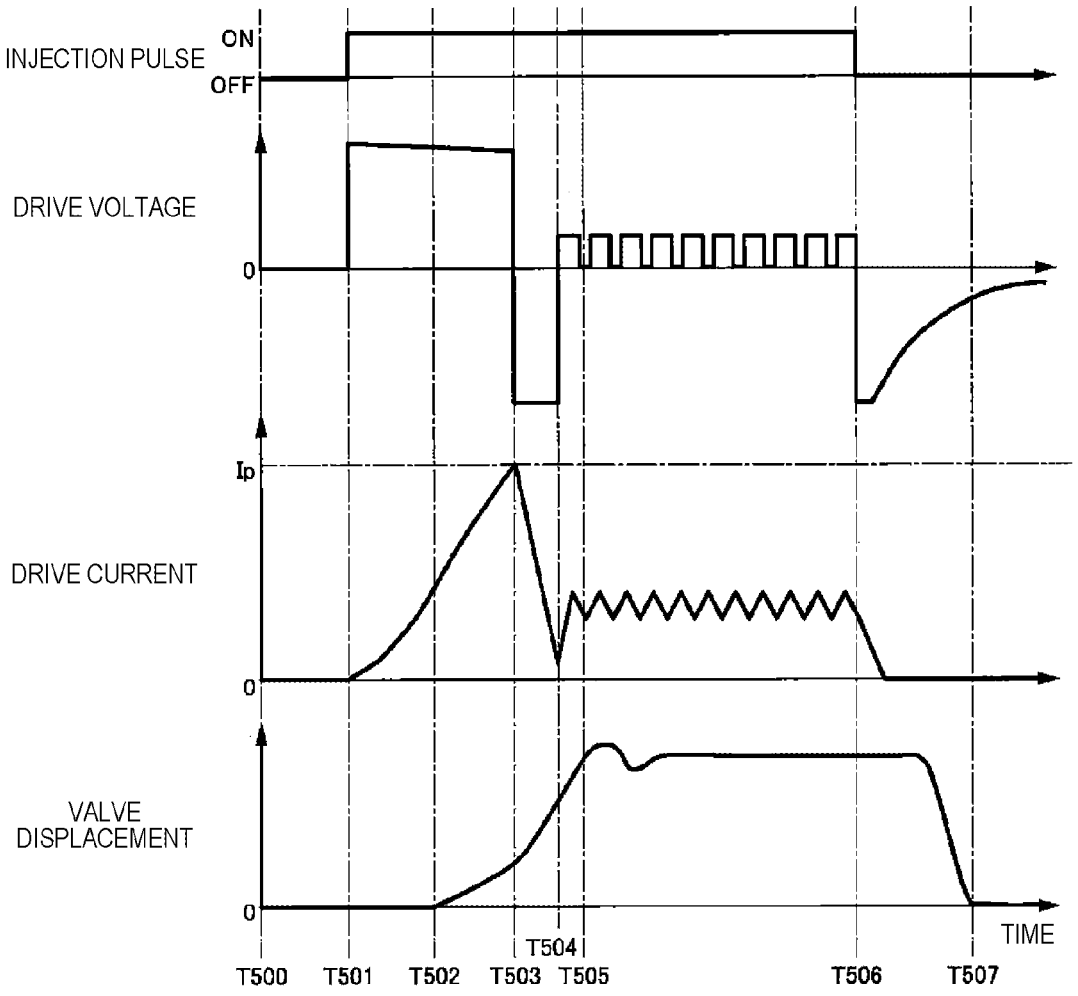
FIG. 5 is a diagram illustrating a method for driving the fuel injection valve shown in FIG. 1.

FIG. 5 is a diagram illustrating the method for driving the fuel injection valve 105.

FIG. 5 shows an example of an injection pulse, a drive voltage, the drive current, and a displacement amount (valve displacement) of the valve body 402 when the fuel is injected from the fuel injection valve 105 in chronological order. When the fuel injection valve 105 is driven, a current set value to be described later is set in advance based on characteristics of the fuel injection valve 105. Injection amount characteristics of the fuel injection valve 105 due to the current set value is stored in a memory (for example, read only memory (RAM)) provided in the ECU 109. The fuel injection control device 127 calculates the injection pulse of the fuel injection valve 105 from an operating state of the internal combustion engine 101 and the injection amount characteristics of the fuel injection valve 105.

At points in time T500 to T501 shown in FIG. 5, the injection pulse output from the fuel injection pulse signal calculation unit 201 (see FIG. 2) is in an off state. Thus, the fuel injection drive units 207*a* and 207*b* enter the off state, and the drive current does not flow through the fuel injection valve 105. Accordingly, the valve body 402 is urged in the valve closing direction by the urging force of the set spring of the fuel injection valve 105, and the distal end portion 402*a* of the valve body 402 abuts on the valve seat 405. Thus, the injection hole 406 is closed, and the fuel is not injected.

Subsequently, at point in time T501, the injection pulse enters an on state, and the fuel injection drive unit 207*a* and the fuel injection drive unit 207*b* are in the on state. Accordingly, the high voltage 210 is applied to the solenoid 407, and the drive current flows through the solenoid 407. When the drive current flows through the solenoid 407, a magnetic flux is generated between the fixed core 404 and the movable core 403, and a magnetic attraction force acts on the movable core 403.

As a result, the movable core 403 starts to move in the valve opening direction (points in time T501 to T502). Thereafter, when the movable core 403 moves by a predetermined length, the movable core 403 and the valve body 402 start to move together (point in time T502), and the valve body 402 is separated from the valve seat 405. Accordingly, the fuel injection valve 105 is opened. As a result, the fuel in the housing 401 is injected from the injection hole 406.

The valve body 402 moves integrally with the movable core 403 until the movable core 403 collides with the fixed core 404. When the movable core 403 collides with the fixed core 404, the movable core 403 is rebounded by the fixed core 404, and the valve body 402 continues to move further in the valve opening direction. Thereafter, when the urging force of the set spring 408 exceeds the magnetic attraction force, the valve body 402 starts to move in the valve closing direction (hereinafter, referred to as a bouncing operation). The bouncing operation of the valve body 402 disturbs the flow rate of the fuel injected from the injection hole 406.

Thus, before the movable core 403 collides with the fixed core 404 (point in time T503), that is, when the drive current reaches a peak current Ip, the switching elements 303, 304, and 306 of the fuel injection drive units 207*a* and 207*b* are in the off state. A high voltage is supplied in an opposite direction, and thus, the drive current flowing through the solenoid 407 is sharply decreased. According, the speeds (force) of the movable core 403 and the valve body 402 are reduced. Accordingly, the bouncing operation of the valve body 402 can be suppressed.

From point in time T504 to point in time T506 at which the injection pulse falls, the fuel injection drive unit 207*b* is maintained in the on state, and the fuel injection drive unit 207*a* is intermittently in the on state.

That is, the drive voltage applied to the solenoid 407 is intermittently set to the battery voltage 209 by controlling the fuel injection drive unit 207*a* by pulse width modulation (PMW), and thus, the drive current flowing through the solenoid 407 falls within a predetermined range. Accordingly, a magnetic attraction force having a magnitude required for attracting the movable core 403 to the fixed core 404 is generated.

At point in time T506, the injection pulse enters the off state. Accordingly, all the fuel injection drive units 207*a* and 207*b* enter the off state, the drive voltage applied to the solenoid 407 decreases, and the drive current flowing through the solenoid 407 decreases. As a result, the magnetic flux generated between the fixed core 404 and the movable core 403 gradually disappears, and the magnetic attraction force acting on the movable core 403 disappears.

When the magnetic attraction force acting on the movable core 403 disappears, the valve body 402 is pushed back in the valve closing direction with a predetermined time delay by the urging force of the set spring 408 and a pressing force due to the fuel pressure. At point in time 1507, the valve body 402 is returned to an original position. That is, the distal end portion 402*a* of the valve body 402 abuts on the valve seat 405, and the fuel injection valve 105 is closed. As a result, the fuel is not injected from the injection hole 406.

From point in time 1506 at which the injection pulse enters the off state, the high voltage 210 is supplied in the opposite direction when the fuel injection valve 105 is driven such that a residual magnetic force in the fuel injection valve 105 is quickly removed and the valve body 402 is early closed.

Next, the injection amount characteristics when the drive current described in detail in FIG. 5 is used will be described with reference to FIG. 6.

Figure 6:
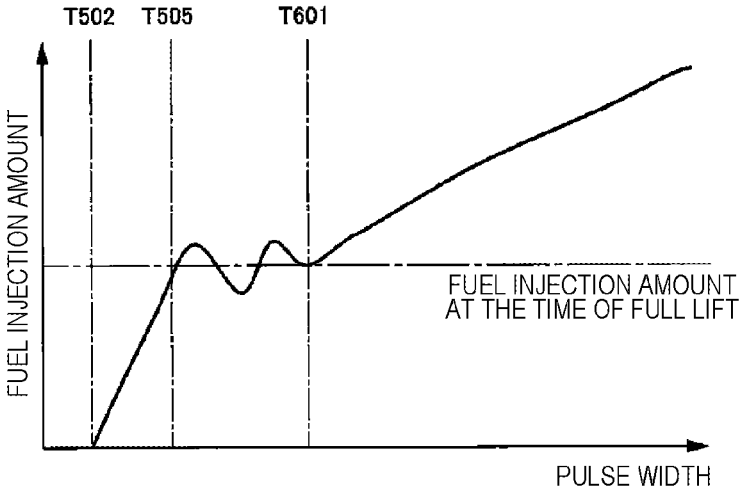
FIG. 6 is a diagram showing a relationship between a fuel injection pulse width and a fuel injection amount of the fuel injection valve shown in FIG. 1.

FIG. 6 is a diagram showing a relationship between the fuel injection pulse width and the fuel injection amount of the fuel injection valve 105, in which a horizontal axis represents the injection pulse width and a vertical axis represents the fuel injection amount for each time.

As shown in FIG. 6, in a period from point in time 1502 at which the valve body 402 starts to be opened to point in time T505 at which the valve body 402 reaches full lift, since a lift amount of the valve body 402 increases based on a supply time of the peak current due to the high voltage application, the fuel injection amount increases. A slope of the fuel injection amount in this period (fuel injection amount increase rate from 1502 to 1505) is decided according to a valve opening speed of the valve body 402. As described above, since a supply power for the peak current is the high voltage 210, the slope of the fuel injection amount becomes a steep gradient.

Thereafter, the movable core 403 collides with the fixed core 404, and thus, the valve body 402 starts the bouncing operation. Accordingly, the fuel injection amount is disturbed (T505 to T601). This bouncing operation period is generally not used as a period in which the fuel injection is performed since characteristics of each fuel injection valve vary widely and the reproducibility of each injection operation is poor. That is, the injection pulse is not set in the bouncing operation period.

Since the valve body 402 after T601 when the bouncing has converged is maintained in a full lift position, the fuel injection amount has increasing characteristics of the slope proportional to a length of the injection pulse.

[Method for Detecting Valve Body Operating Time]

Next, a method for detecting the valve body operating time of the fuel injection valve 105 executed by the valve body operating time detection unit 211 will be described with reference to FIGS. 7 to 9.

Figure 7:
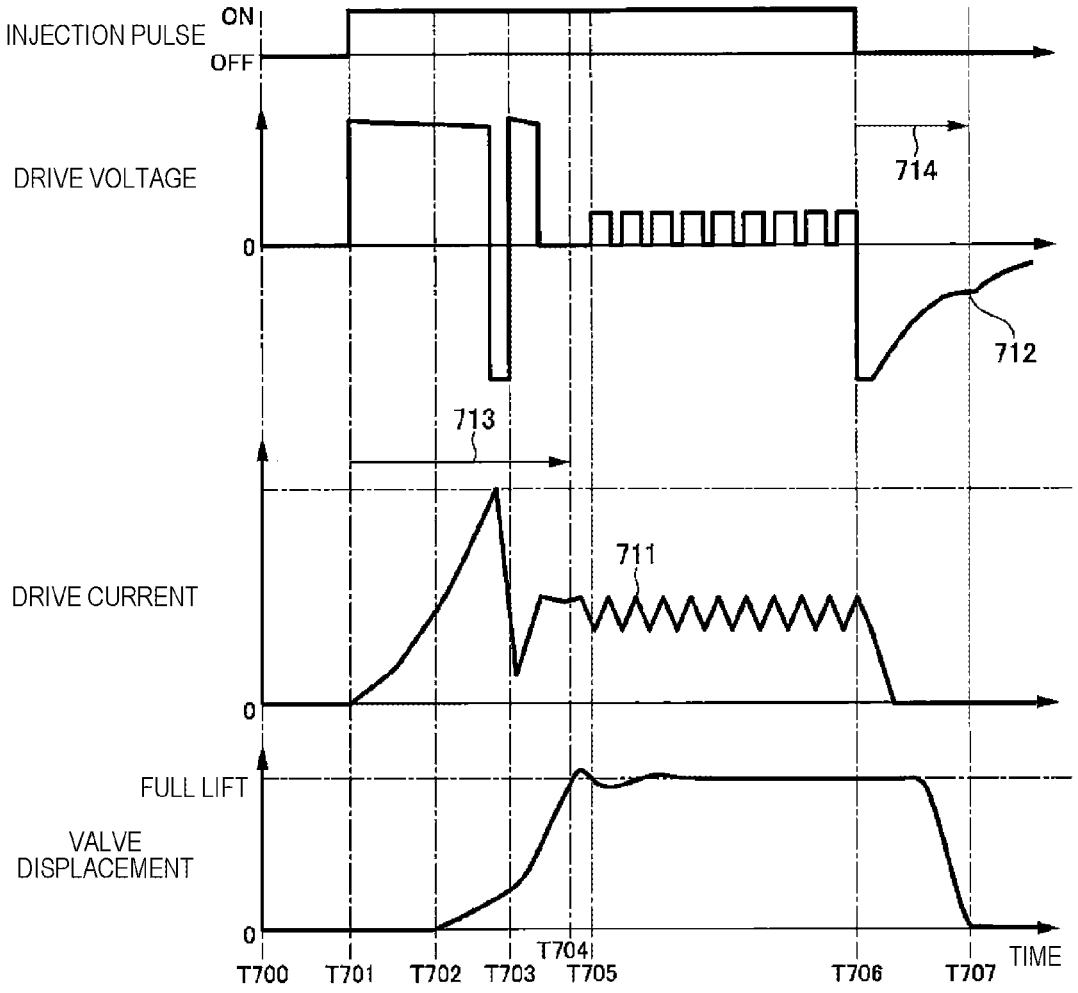
FIG. 7 is a diagram illustrating detection of a valve closing time and a valve opening time using a drive voltage and a drive current in the fuel injection valve shown in FIG. 1.

FIG. 7 is a diagram illustrating detection of a valve closing time and a valve opening time using the drive voltage and the drive current in the fuel injection valve 105. FIG. 8 is a diagram illustrating a method for detecting an inflection point of the drive voltage in the fuel injection valve 105. FIG. 9 is a diagram illustrating a method for detecting an inflection point of the drive current in the fuel injection valve 105.

As shown in FIG. 7, the valve body operating time of the fuel injection valve 105 is defined as a valve opening time 713 from a certain reference point (point in time 1701) to the completion of the valve opening (point in time T704) or a valve closing time 714 from a certain reference point (point in time 1706) to the completion of the valve closing (point in time 1707).

As described above, when the valve body 402 of the fuel injection valve 105 is opened, the high voltage 210 is applied to the solenoid 407, a relatively large drive current flows, and the movable core 403 and the valve body 402 are accelerated. Subsequently, the high voltage 210 applied to the solenoid 407 is cut off, and the drive current flowing through the solenoid 407 decreases to a predetermined value.

Thereafter, when the battery voltage 209 is applied to the solenoid 407, the movable core 403 collides with the fixed core 404 in a state in which the drive current flowing through the solenoid 407 is stable. When the movable core 403 and the fixed core 404 collide with each other, the acceleration of the movable core 403 changes and an inductance of the solenoid 407 changes.

Here, it is considered that the change in the inductance of the solenoid 407 appears as an inflection point in the drive current flowing through the solenoid 407 or the drive voltage applied to the solenoid 407. However, when the fuel injection valve 105 is opened, since the drive voltage is maintained at a substantially constant value, the inflection point does not appear in the drive voltage but appears in the drive current (inflection point 711).

On the other hand, when the fuel injection valve 105 is closed and the valve body 402 collides with the valve seat 405, the zero spring 409 changes from expansion to compression, and a motion direction of the movable core 403 is reversed. Accordingly, an acceleration changes, and the inductance of the solenoid 407 changes. That is, when the fuel injection valve 105 is closed, the drive current flowing through the solenoid 407 is cut off, and a counter-electromotive force is applied to the solenoid 407. When the drive current converges, since the counter-electromotive force gradually decreases, the inductance changes when the counter-electromotive force decreases, and thus, the inflection point is generated in the drive voltage (inflection point 712).

The inflection point 711 of the drive current that appears when the fuel injection valve 105 is opened is a valve opening timing of the fuel injection valve 105. Thus, the valve opening time 713 can be detected by measuring a time from a timing at which the injection pulse is turned on to the inflection point 711 of the drive current.

The inflection point 712 of the drive voltage that appears when the fuel injection valve 105 is closed is a valve closing timing of the fuel injection valve 105. Thus, the valve closing time 714 can be detected by measuring a time from a timing at which the injection pulse is turned off to the inflection point 712 of the drive voltage.

When second-order differentiation is performed on time series data of the drive current flowing through the solenoid 407, the inflection point 711 appears as an extreme value (maximum value or minimum value). When second-order differentiation is performed on time series data of the drive voltage applied to the solenoid 407, the inflection point 712 appears as an extreme value (maximum value or minimum value). Accordingly, the inflection points 712 and 713 can be specified by detecting the extreme value of the time series data of the drive current or the drive voltage.

Figure 8:
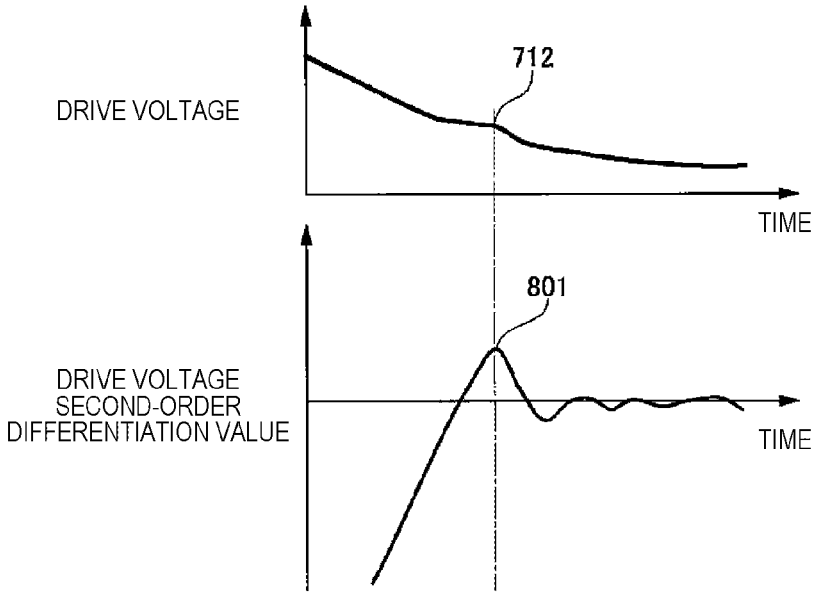
FIG. 8 is a diagram illustrating a method for detecting an inflection point of the drive voltage in the fuel injection valve shown in FIG. 1.
Figure 9:
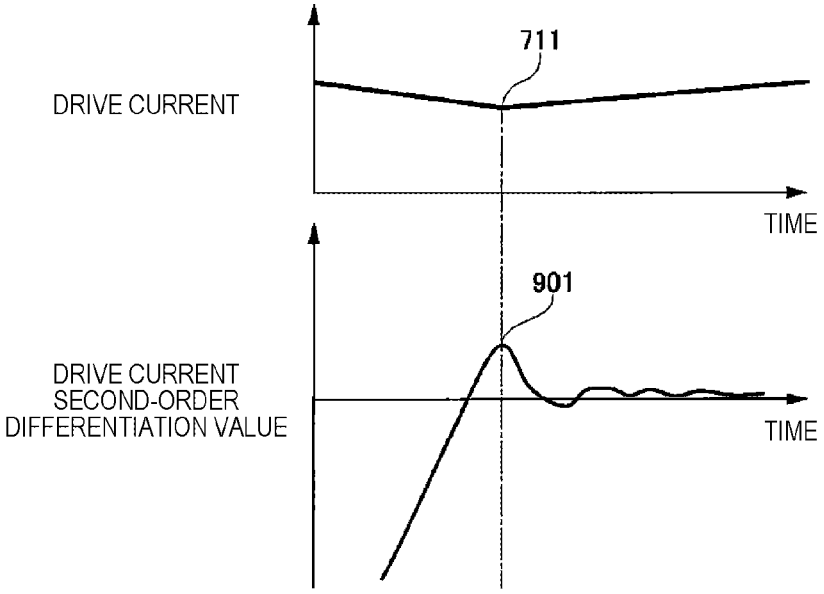
FIG. 9 is a diagram illustrating a method for detecting an inflection point of the drive current in the fuel injection valve shown in FIG. 1.

FIG. 8 shows pieces of time series data of the drive voltage of the fuel injection valve 105 during the valve closing operation and a second-order differential value thereof. The drive voltage shown in FIG. 8 is described by reversing positive and negative in FIGS. 5 and 7. A reference sign 801 indicated in FIG. 8 is an extreme value corresponding to the inflection point 712. FIG. 9 shows the time series data of the drive current of the fuel injection valve 105 during the valve opening operation and a second-order differential value thereof. A reference sign 901 indicated in FIG. 9 is an extreme value corresponding to the inflection point 711.

When an S/N ratio of the drive current or the drive voltage is low and a noise level thereof is large, it becomes difficult to detect the extreme value from the result of the second-order differentiation of the time series data of the drive current or drive voltage.

Thus, a desired extreme value can be detected by applying a low-pass filter or the like to the drive current and the drive voltage and performing the second-order differentiation on smoothed time series data. The second-order differential value of the drive voltage shown in FIG. 8 is obtained by filtering the drive voltage and performing the second-order differentiation on the smoothed data. The second-order differential value of the drive current shown in FIG. 9 is obtained by filtering the drive current and performing the second-order differentiation on the smoothed data.

When the second-order differentiation is performed on time series data of the drive current from a time at which the injection pulse is turned on or time series data of the drive voltage from a time at which the injection pulse is turned off, a time to switch between the voltages (for example, a time to switch from the high voltage 210 to the battery voltage 209 or a time to apply the counter-electromotive force after the drive voltage is turned off) may appear as an extreme value. By doing this, the inflection point generated by the acceleration change of the movable core 403 cannot be accurately specified.

Accordingly, it is desirable that the time series data of the drive current on which the second-order differentiation is performed is time series data of the drive current after a certain time has passed after the injection pulse enters the on state (in other words, after the drive voltage or the drive current is turned on). That is, it is desirable that the time series data of the drive current on which the second-order differentiation is performed is time series data of the drive current after the voltage is switched from the high voltage 210 to the battery voltage 209.

It is desirable that the time series data of the drive voltage on which the second-order differentiation is performed is time series data of the drive voltage after a certain time has passed after the injection pulse enters the off state (in other words, after the drive voltage or the drive current is off). That is, it is desirable that the time series data of the drive voltage on which the second-order differentiation is performed is time series data of the drive voltage after the counter-electromotive force is applied after the drive voltage is turned off.

[Half Lift Control]

Next, an example of half lift control based on the method for driving the fuel injection valve 105 described with reference to FIG. 5 will be described with reference to FIG. 10.

Figure 10:
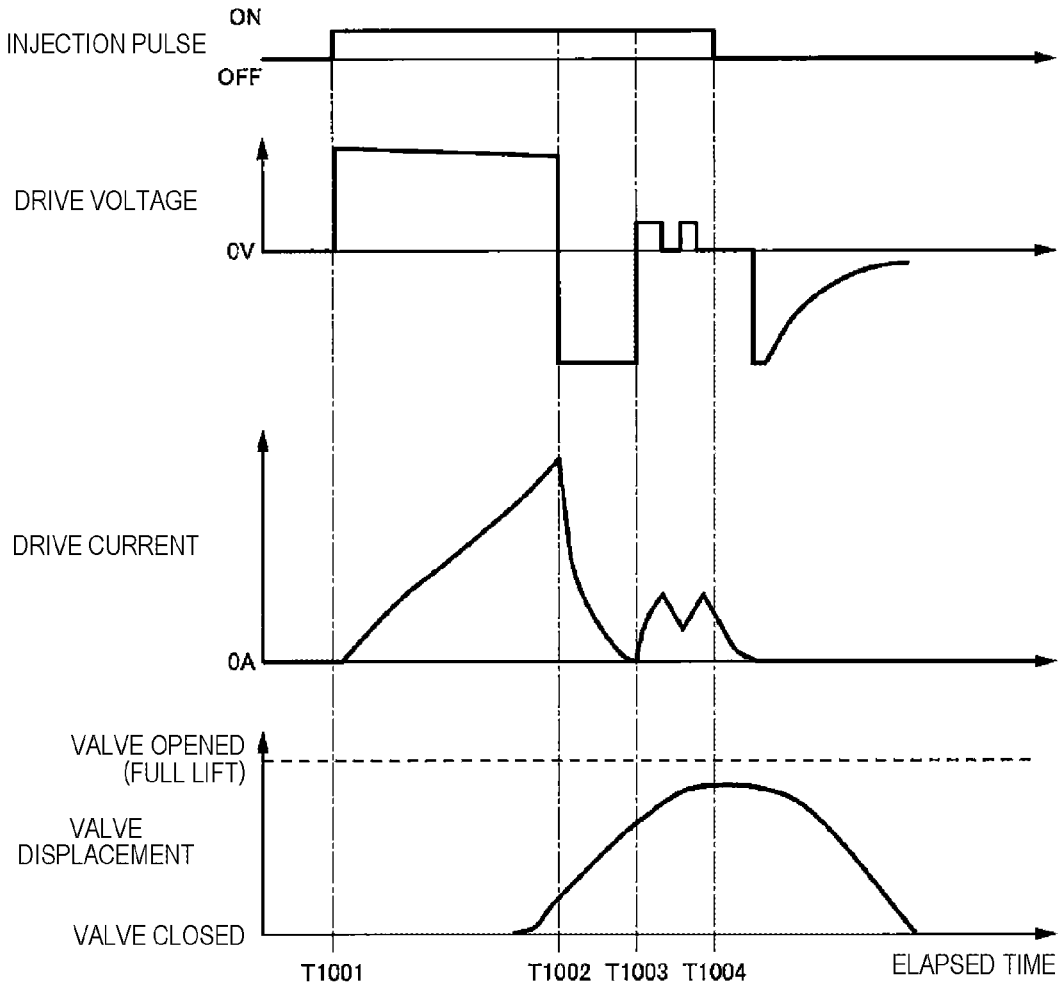
FIG. 10 is a diagram illustrating a method for driving the fuel injection valve at the time of half lift control according to the embodiment of the present invention.

FIG. 10 is a diagram illustrating a method for driving the fuel injection valve 105 at the time of the half lift control.

First, the half lift control is defined as control for operating the valve body 402 such that a behavior thereof draws a parabola by turning off the injection pulse in a period from when the fuel injection valve 105 starts the valve opening operation to when the fuel injection valve reaches the full lift (a period from point in time T502 to point in time 1505 shown in FIG. 5). However, when the injection pulse is turned off at 1502, the fuel is not injected.

The high voltage 210 is applied to the solenoid 407 from point in time T1001 at which the injection pulse shown in FIG. is turned on, and a valve opening peak current flows. After the high voltage 210 is applied to the solenoid 407, the movable core 403 is displaced in the valve opening direction by the magnetic attraction force acting on the movable core 403, and performs an idle running operation. Thereafter, the movable core 403 comes into contact with the rear end portion 402*b* of the valve body 402, the valve body 402 starts to be displaced, and the fuel is injected from the injection hole 406.

Subsequently, after the high voltage 210 is applied, a current value is sharply decreased by turning off the fuel injection drive units 207*a* and 207*b* (point in time T1002) and applying the high voltage 210 in a negative direction. The current flowing through the solenoid 407 is reduced due to this voltage cutoff, the magnetic attraction force acting on the movable core 403 is reduced, and kinetic energy of the valve body 402 is reduced. As a result, a moving speed of the valve body 402 (a valve opening speed of the fuel injection valve 105) is suppressed.

Thereafter, a holding current due to the application of the low voltage such as the battery voltage 209 is supplied, and thus, the magnetic attraction force starts to increase again and the valve body 402 is accelerated (point in time T1003). The injection pulse is turned off at a point in time (point in time T1004) before the valve body 402 reaches the full lift position. Accordingly, the fuel injection valve 105 starts the valve closing operation before the valve body 402 reaches the full lift position, and is eventually closed.

An increase in the lift amount after the voltage is cut off can be controlled by a length of a time in which the holding current flows (holding current supply time) or a magnitude of the holding current. Thus, the valve body 402 can reach the full lift position by lengthening the holding current supply time or increasing the holding current, and the fuel can be injected. It is possible to continuously increase the lift amount to the full lift position without causing bouncing while providing a gentle valve opening operation by performing the half lift control in this manner.

Figure 11:
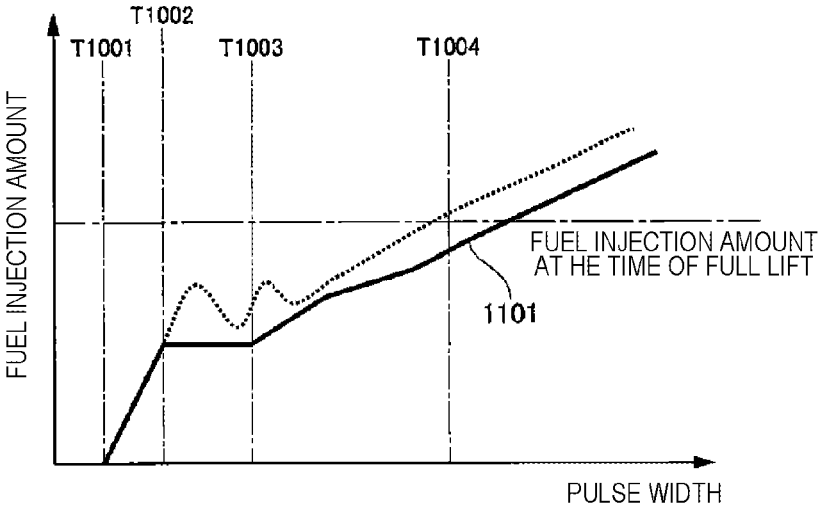
FIG. 11 is a diagram showing a relationship between the fuel injection pulse width and the fuel injection amount of the fuel injection valve at the time of the half lift control according to the embodiment of the present invention.

FIG. 11 is a diagram showing the injection amount characteristics when the half lift control shown in FIG. 10 is performed.

The injection amount characteristics indicated by a broken line in FIG. 11 are the injection amount characteristics shown in FIG. 6 (injection amount characteristics when the method for driving the fuel injection valve 105 shown in FIG. 5 is performed).

As shown in FIG. 11, injection amount characteristics 1101 rise from point in time T1001 at which the fuel injection valve 105 starts the valve opening operation to point in time T1002 at which the current reaches the peak current. At point in time T1002, the voltage is cut off.

During the voltage cutoff (T1002 to T1003), since the drive current does not change irrespective of a part at which the injection pulse is turned off, a valve behavior draws the same trajectory. Thus, the injection amount characteristics 1101 become flat until point in time T1003 which is a timing at which the voltage cutoff is ended, and then the injection amount characteristics start to rise again by starting the application of the low voltage.

[Correction Amount of Drive Current]

Next, the correction amount of the drive current calculated by the drive current correction amount calculation unit 212 will be described with reference to FIGS. 12 to 18.

The drive current correction amount calculation unit 212 calculates the correction amount of the drive current. The injection amount characteristics are uniform by correcting the drive current based on a calculation result of the drive current correction amount calculation unit 212, and an injection amount variation is reduced. Specifically, the correction of the drive current can be achieved by correcting a boosted voltage application time and voltage cutoff start timing or end timing. The correction of the drive current can be achieved by correcting the holding current or the holding current supply period.

First, a method for correcting the boosted voltage application time will be described with reference to FIG. 12.

Figure 12:
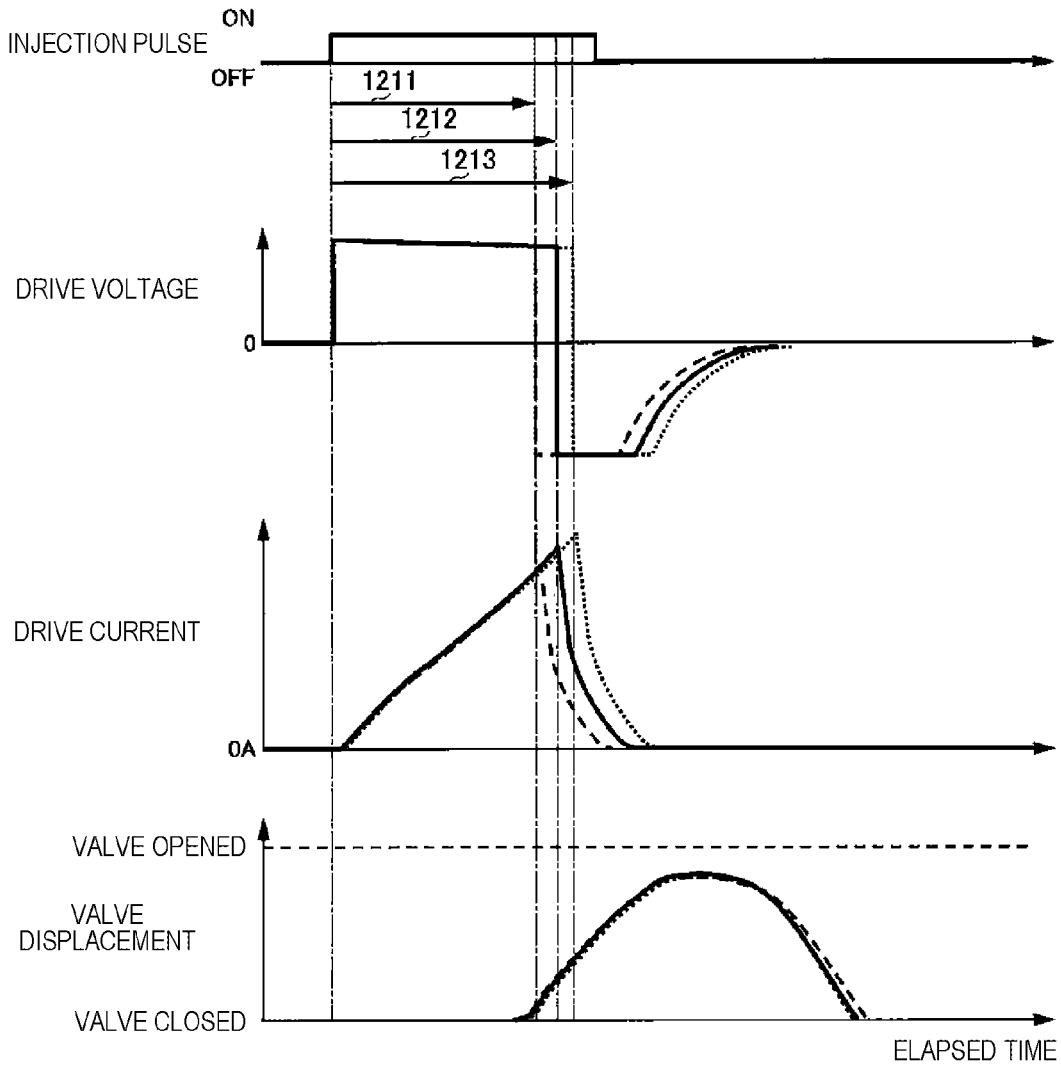
FIG. 12 is a diagram illustrating voltage and current control at the time of the half lift control according to the embodiment of the present invention.

FIG. 12 is a diagram illustrating voltage and current control at the time of the half lift control.

Solid lines indicated in FIG. 12 are examples of various waveforms of (predetermined) fuel injection valve as a reference. Dotted lines shown in FIG. 12 are examples of various waveforms of the fuel injection valve having a relatively strong spring force of the set spring 408 and broken lines are examples of various waveforms of the fuel injection valves having a relatively weak spring force of the set spring 408.

The boosted voltage application time is determined based on the valve closing time or valve opening time that indirectly detects the variation in the fuel injection valve. The boosted voltage application time is set to be shorter than a time for the movable core 403 to reach (abut on) the fixed core 404 in order to prevent bouncing due to an excess valve opening force.

However, the boosted voltage application time needs be longer than a period corresponding to the current value (minimum guaranteed current value with which the fuel injection valve can be opened) with which the fuel injection valve can be reliably opened even under a maximum fuel pressure at which the fuel injection valve is used. That is, the boosted voltage application time is a time in which at least the valve opening of the fuel injection valve can be guaranteed by generating a minimum magnetic attraction force required for the valve opening operation of the fuel injection valve.

Here, it is assumed that the (predetermined) fuel injection valve as the reference is a fuel injection valve 105P.

It is assumed that the fuel injection valve in which the spring force of the set spring 408 is relatively stronger than the fuel injection valve 105P is a fuel injection valve 1055 and the fuel injection valve in which the spring force of the set spring 408 is relatively weaker than the fuel injection valve 105P is a fuel injection valve is 105W.

The fuel injection valve 105S has a shorter valve closing time and a longer valve opening time than the fuel injection valve 105P.

A boosted voltage application time 1213 of the fuel injection valve 105S is longer than a boosted voltage application time 1212 of the fuel injection valve 105P. That is, a timing at which the drive voltage of the fuel injection valve 1055 is cut off is later than a timing at which the drive voltage of the fuel injection valve 105P is cut off.

Accordingly, a value of the drive current flowing through the solenoid 407 of the fuel injection valve 105S becomes larger than a value of the drive current flowing through the solenoid 407 of the fuel injection valve 105P. As a result, the magnetic attraction force acting on the movable core 403 of the fuel injection valve 105S becomes larger than the magnetic attraction force acting on the movable core 403 of the fuel injection valve 105P. Accordingly, the valve opening time of the fuel injection valve 105S can be shortened to approach the valve opening time of the fuel injection valve 105P.

The fuel injection valve 105W has a longer valve closing time and a shorter valve opening time than the fuel injection valve 105P.

A boosted voltage application time 1211 of the fuel injection valve 105W is shorter than a boosted voltage application time 1212 of the fuel injection valve 105P. That is, a timing at which the drive voltage of the fuel injection valve 105W is cut off is earlier than a timing at which the drive voltage of the fuel injection valve 105P is cut off.

Accordingly, a value of the drive current flowing through the solenoid 407 of the fuel injection valve 105W becomes smaller than a value of the drive current flowing through the solenoid 407 of the fuel injection valve 105P. As a result, the magnetic attraction force acting on the movable core 403 of the fuel injection valve 105W becomes smaller than the magnetic attraction force acting on the movable core 403 of the fuel injection valve 105P. Accordingly, the valve opening time of the fuel injection valve 105W can be lengthened to approach the valve opening time of the fuel injection valve 105P.

As stated above, the magnetic attraction force corresponding to a machine difference variation between the fuel injection valves 105P, 1055, and 105W acts by setting the boosted voltage application time to be longer or shorter than the boosted voltage application time 1212 of the fuel injection valve 105P as the reference, and thus, the valve behavior at the time of the valve opening can be uniform.

The valve closing time and the valve opening time of each of the fuel injection valves 105P, 105S, and 105W may be measured in advance, and the boosted voltage application time correction amount may be calculated based on the valve closing time and the valve opening time.

However, it is possible to correct the boosted voltage application time in a wide operating state by measuring the valve closing time and the valve opening time in a plurality of operating states and by recording the measured valve closing time and valve opening time in the memory of the ECU 109.

The valve closing time and the valve opening time are measured during operation, and thus, it becomes possible to monitor a state of temporal deterioration of the fuel injection valve 105 over time. Thus, even though an operation of the fuel injection valve 105 changes due to the deterioration over time, the boosted voltage application time can be corrected according to the deterioration over time, and the injection amount variation can be reduced.

Figure 13:
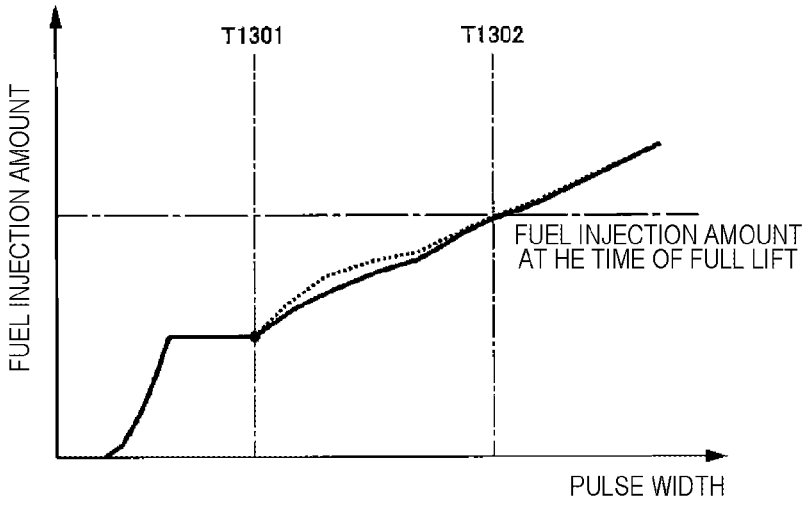
FIG. 13 is a diagram illustrating variation in the injection amount at the time of the half lift control.

FIG. 13 shows the injection amount characteristics when the boosted voltage application time changes for each fuel injection valve. In FIG. the injection amount characteristics of the fuel injection valve 105S having a relatively strong spring force of the set spring 408 are indicated by a solid line, and the injection characteristics of the fuel injection valve 105W having a relatively weak spring force of the set spring 408 are indicated by a dotted line.

As described above, the injection amount characteristics in a half lift region can be linearly increased by correcting the boosted voltage application time by using the valve opening time or the valve closing time, and the injection amount variation can be reduced. However, as represented in a period from point in time T1301 to point in time 11302 in FIG. 13, in a region in which the injection amount increases in the half lift region, although linearity is improved with respect to the injection amount characteristics shown in FIG. 6, the linearity is disturbed in some fuel injection valves, and the injection amount varies.

At point in time T1301, the magnetic attraction force generated in the solenoid 407 is reduced. However, the magnetic attraction force becomes large by supplying the current due to the low voltage afterward, and a rising speed of the valve body 402 becomes large. At this time, a time required for the magnetic attraction force generated in the solenoid 407 to become larger than the spring force of the set spring 408 becomes slower as the spring force of the set spring 408 becomes larger, and becomes faster as the spring force of the set spring 408 becomes smaller. That is, as the spring force of the set spring 408 becomes larger, the injection amount after point in time 11301 becomes smaller, and as the spring force of the set spring 408 becomes smaller, the injection amount after point in time T1301 becomes larger. As a result, the injection amount varies.

In order to reduce the injection amount variation after point in time T1301, the magnetic attraction force acting on the valve body 402 in the half lift region may be changed according to the valve closing time or the valve opening time influenced by the spring force of the set spring 408. In order to change the magnetic attraction force in the half lift region, the voltage cutoff end timing or the voltage cutoff start timing after the boosted voltage is applied and the holding current or the low voltage application time (holding current supply period) may be changed.

For example, in order to match the magnetic attraction force of the fuel injection valve having a relatively weak spring force of the set spring 408 with the magnetic attraction force of the fuel injection valve having a relatively strong spring force of the set spring 408, the correction is performed such that the magnetic attraction force is suppressed (is decreased). In order to match the magnetic attraction force of the fuel injection valve having a relatively strong spring force of the set spring 408 with the magnetic attraction force of the fuel injection valve having a relatively weak spring force of the set spring 408, the correction is performed such that the magnetic attraction force becomes large.

Next, the correction of the voltage cutoff end timing will be described with reference to FIGS. 14 to 16.

Figure 14:
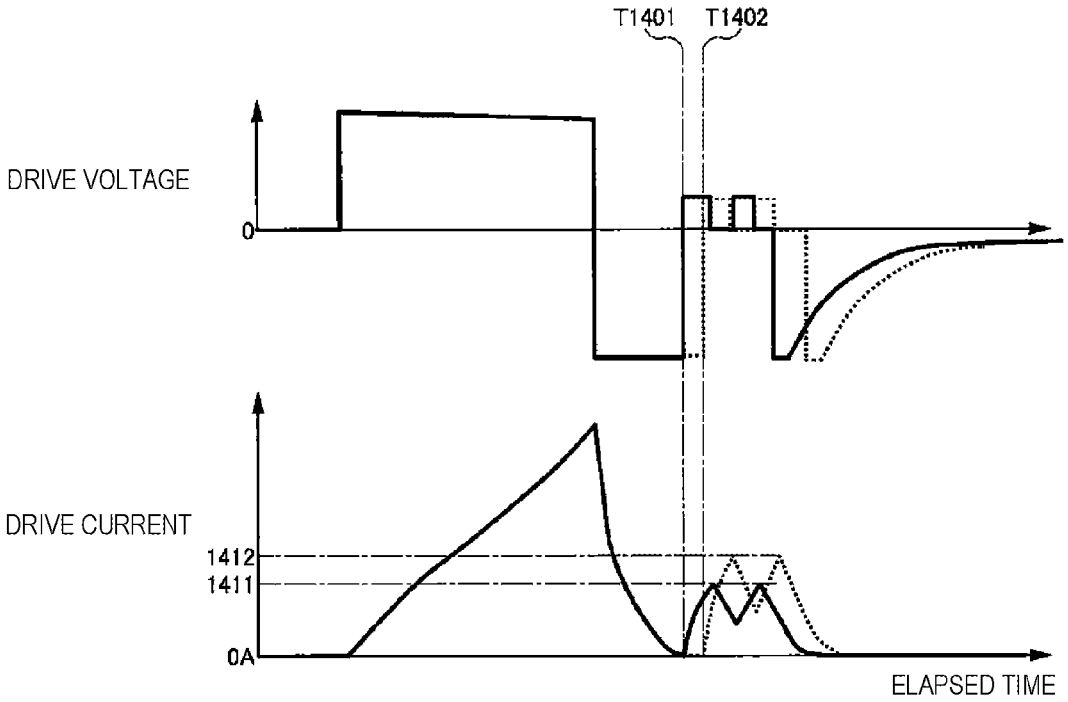
FIG. 14 is a diagram illustrating a method for correcting a voltage cutoff end timing at the time of the half lift control according to the embodiment of the present invention.

FIG. 14 is a diagram illustrating a method for correcting the voltage cutoff end timing at the time of the half lift control. FIG. 15 is a diagram showing a relationship between the fuel injection pulse width and the fuel injection amount of the fuel injection valve when correction for delaying the voltage cutoff end timing is performed at the time of the half lift control. FIG. 16 is a diagram showing a relationship between the fuel injection pulse width and the fuel injection amount of the fuel injection valve when correction for advancing the voltage cutoff end timing is performed at the time of the half lift control.

As shown in FIG. 14, the voltage cutoff end timing (point in time T1402) of the fuel injection valve having a long valve closing time and a short valve opening time is relatively further delayed than the voltage cutoff end timing (point in time T1401) of the fuel injection valve having a short valve closing time and a long valve opening time. Accordingly, it is possible to relatively reduce the rising speed of the valve body 402 of the fuel injection valve having a long valve closing time and a short valve opening time, and it is possible to delay the rise of the magnetic attraction force due to the holding current.

As a result, a timing at which the valve body 402 is reaccelerated in the valve opening direction can be delayed, and the injection amount characteristics of the fuel injection valve having a long valve closing time and a short valve opening time can approach the injection amount characteristics of the fuel injection valve having a short valve closing time and a long valve opening time.

In the present embodiment, when the voltage cutoff end timing is delayed, the subsequent holding current 1412 is set to a larger value than a holding current 1411 of the fuel injection valve having a short valve closing time and a long valve opening time, and the rise (movement in the valve opening direction) of the valve body 402 is encouraged.

In general, a small holding current is set for the fuel injection valve having a long valve closing time and a short valve opening time in order to decrease the magnetic attraction force. However, when the voltage cutoff end timing is delayed and the holding current is decreased, the rising speed of the valve body 402 becomes too slow, and the injection amount characteristics shown in FIG. 15 are convex downward (below the solid line).

Thus, a value of the holding current 1412 of the fuel injection valve having a long valve closing time and a short valve opening time as described above is larger than a value of the holding current 1411 of the fuel injection valve having a short valve closing time and a long valve opening time. Accordingly, the valve body 402 can be encouraged to rise (move in the valve opening direction) in the fuel injection valve having a long valve closing time and a short valve opening time, and the rising speed can be prevented from becoming too slow.

Figure 15:
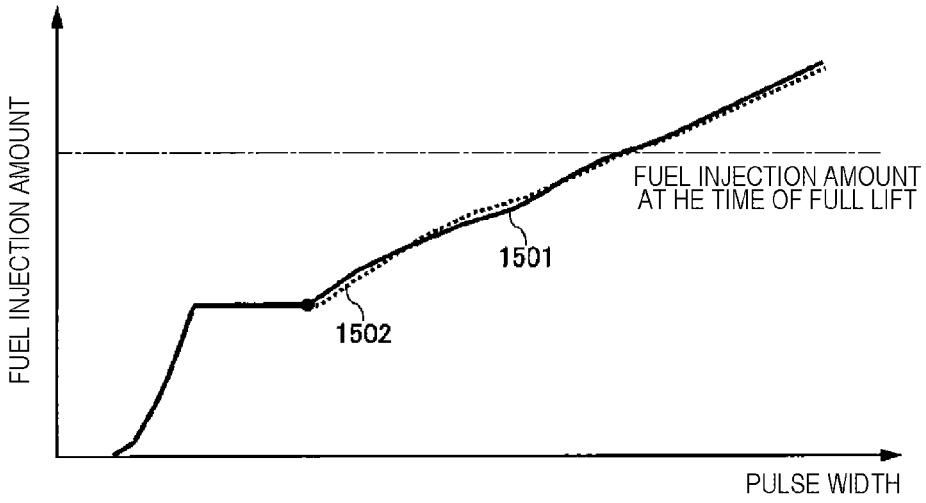
FIG. 15 is a diagram showing a relationship between the fuel injection pulse width and the fuel injection amount of the fuel injection valve when correction for delaying the voltage cutoff end timing is performed at the time of the half lift control according to the embodiment of the present invention.

Accordingly, as shown in FIG. 15, injection amount characteristics 1502 of the fuel injection valve having a long valve closing time and a short valve opening time in the half lift region can further approach injection amount characteristics 1501 of the fuel injection valve having a short valve closing time and a long valve closing time in the half lift region. As a result, it is possible to reduce the variations in the injection amounts, and the linearity of the injection amount characteristics is also improved. Accordingly, controllability of the fuel injection valves is improved.

The voltage cutoff end timing of the fuel injection valve having a short valve closing time and a long valve opening time may be relatively further advanced than the voltage cutoff end timing of the fuel injection valve having a long valve closing time and a short valve opening time. Accordingly, it is possible to relatively increase the rising speed of the valve body 402 of the fuel injection valve having a short valve closing time and a long valve opening time, and it is possible to accelerate the rise of the magnetic attraction force due to the holding current.

As a result, a timing at which the valve body 402 is reaccelerated in the valve opening direction can be accelerated, and the injection amount characteristics of the fuel injection valve having a short valve closing time and a long valve opening time can approach the injection amount characteristics of the fuel injection valve having a long valve closing time and a short valve opening time.

When the voltage cutoff end timing is corrected in this way, since the rising speed of the valve body 402 is increased, the injection amount increases in the half lift region. Thus, when the voltage cutoff end timing is advanced, the subsequent holding current is set to be smaller than the holding current of the fuel injection valve having a long valve closing time and a short valve opening time, and the rise of the valve body 402 (movement in the valve opening direction) is suppressed.

Figure 16:
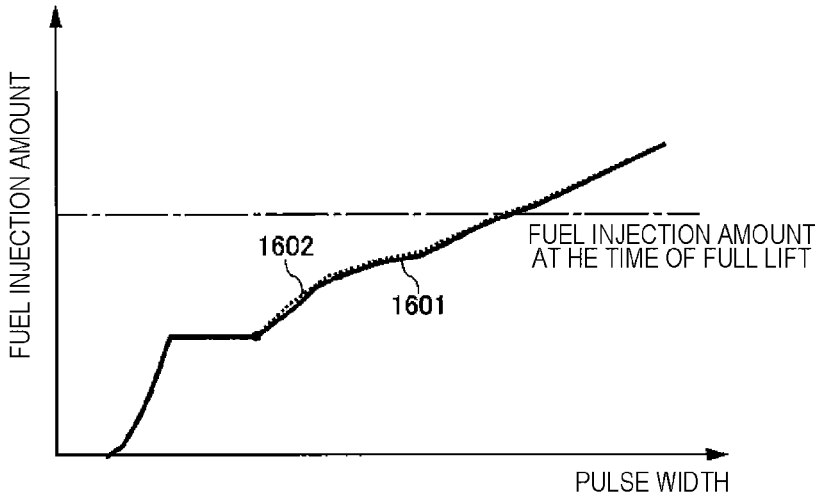
FIG. 16 is a diagram showing a relationship between the fuel injection pulse width and the fuel injection amount of the fuel injection valve when correction for advancing the voltage cutoff end timing at the time of the half lift control according to the embodiment of the present invention is performed.

Accordingly, as shown in FIG. 16, injection amount characteristic 1601 of the fuel injection valve having a short valve closing time and a long valve opening time in the half lift region can be matched with (further approach) injection amount characteristics 1602 of the fuel injection valve having a long valve closing time and a short valve opening time in the half lift region. As a result, it is possible to reduce the variations in the injection amounts.

It can be said that the correction for changing the voltage cutoff end timing described above is a correction for changing a time in which the high voltage 202 and the battery voltage 209 are cut off for the solenoid 407 of the fuel injection valve.

Next, a correction method for correcting the voltage cutoff start timing and uniformizing the end timing will be described with reference to FIGS. 17 and 18.

Figure 17:
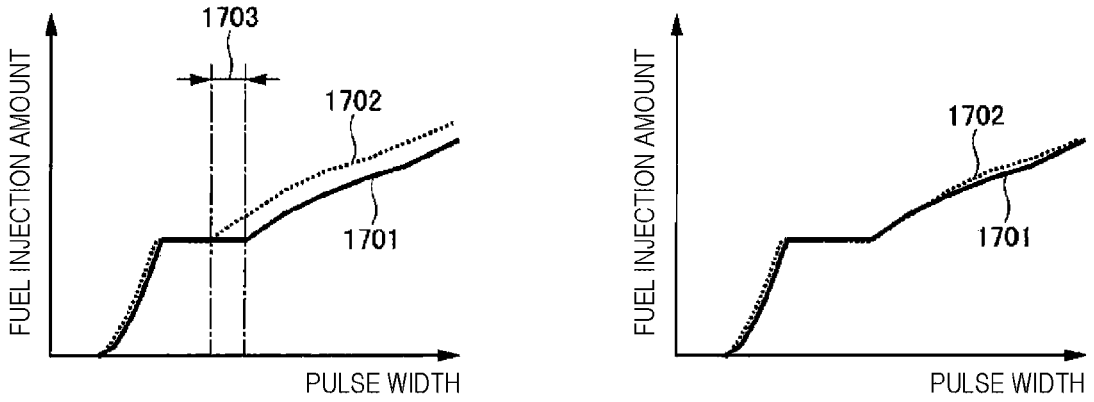
FIG. 17 is a diagram illustrating an influence on injection amount characteristics when the voltage cutoff end timing is corrected at the time of the half lift control according to the embodiment of the present invention.

FIG. 17 is a diagram illustrating the influence on the injection amount characteristics when the voltage cutoff end timing is corrected at the time of the half lift control. FIG. is a diagram illustrating a method for correcting the voltage cutoff start timing at the time of the half lift control.

As described above, a flat portion of the injection amount characteristics is generated by the voltage cutoff. This is because the injection amount does not change in this period by turning off all switch units irrespective off a time when the injection pulse is turned off during the voltage cutoff. Accordingly, the voltage cutoff end timing is changed, and thus, a timing at which a flow rate increases from a flow rate flat portion changes.

As shown in the left figure of FIG. 17, injection amount characteristics 1702 of the fuel injection valve having an early voltage cutoff end timing has an offset 1703 with respect to injection amount characteristics 1701 of the fuel injection valve having a late voltage cutoff end timing.

Since the generated offset 1703 depends on a change amount of the voltage cutoff end timing, it is possible to match the injection amount by reflecting the change amount of the voltage cutoff end timing in the injection pulse. However, as shown in the right figure of FIG. 17, it is possible to match the injection amount for the injection pulse width by setting the voltage cutoff end timings to be the same.

Figure 18:
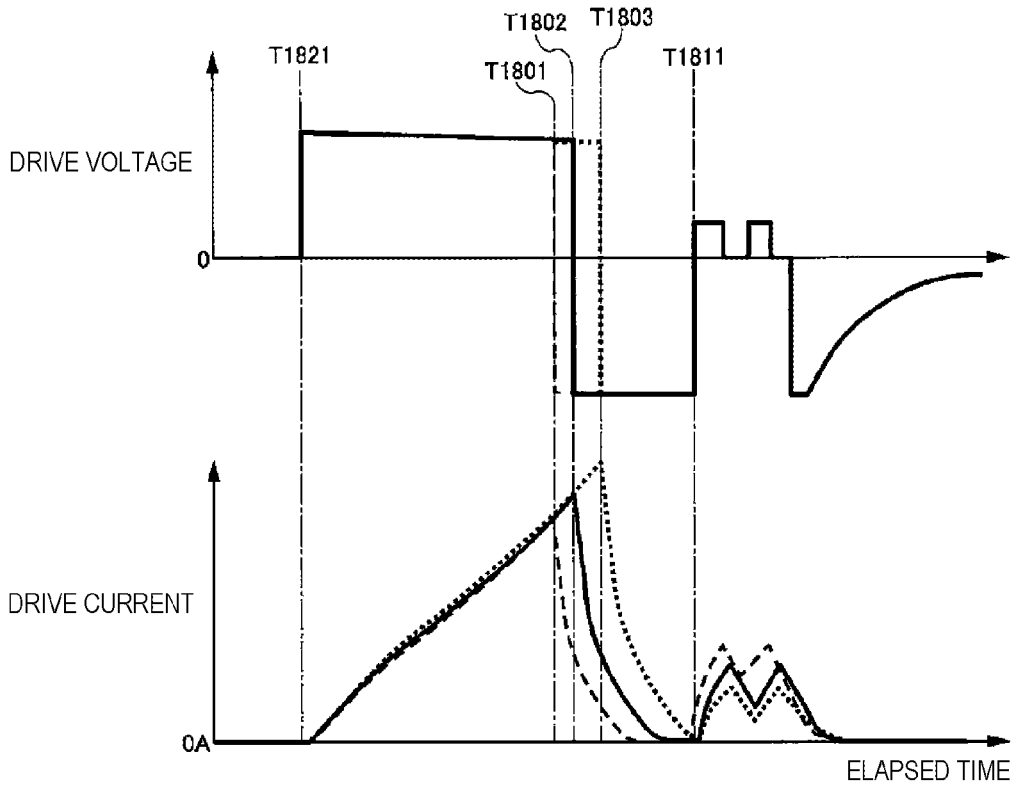
FIG. 18 is a diagram illustrating a method for correcting a voltage cutoff start timing at the time of the half lift control according to the embodiment of the present invention.

As shown in FIG. 18, the voltage cutoff start timings (point in time T1801, point in time T1802, and point in time 11803) are changed for each fuel injection valve by setting the voltage cutoff end timings (point in time 11811) of the plurality of fuel injection valves having different valve closing times (valve opening times) to be the same.

Point in time 11801 is the voltage cutoff start timing of the fuel injection valve having a relatively weak spring force of the set spring 408. Point in time 11802 is the voltage cutoff start timing of the fuel injection valve having a relatively stronger spring force of the set spring 408 than the fuel injection valve of which the voltage cutoff start timing is point in time 11801. Point in time 11803 is the voltage cutoff start timing of the fuel injection valve having a relatively stronger spring force of the set spring 408 than the fuel injection valve of which the voltage cutoff start timing is point in time 11802.

That is, the fuel injection valve of which the voltage cutoff start timing is point in time T1801 has a longer valve closing time and a shorter valve opening time than the fuel injection valves of which the voltage cutoff start timings are points in time 11802 and 11803. The fuel injection valve of which the voltage cutoff start timing is point in time 11802 has a longer valve closing time and a shorter valve opening time than the fuel injection valve of which the voltage cutoff start timing is point in time T1803.

When the voltage cutoff end timings (point in time 11811) are set to the same timing, for example, the (predetermined) fuel injection valve as the reference may be used as the fuel injection valve having the strongest spring force of the set spring 408 (fuel injection valve of which voltage cutoff start timing is point in time 11803). Accordingly, the linearity of the injection amount characteristics can be secured.

The fuel injection valve as the reference may be the fuel injection valve having the strongest spring force of the set spring 408 (fuel injection valve of which the voltage cutoff start timing is point in time 11801). In this case, the linearity of the injection amount characteristics is further disturbed than when the fuel injection valve having the strongest spring force of the set spring 408 is used as the fuel injection valve as the reference, but the injection amount characteristics of the plurality of fuel injection valves can be uniform.

In the example shown in FIG. 18, the voltage cutoff end timings (point in time T1811) of the three fuel injection valves are matched with the voltage cutoff end timing of the fuel injection valve of which the spring force of the set spring 408 is middle (of which the voltage cutoff start timing is point in time T1802). That is, the fuel injection valve as the reference is used as the fuel injection valve of which the spring force of the set spring 408 is middle (of which the voltage cutoff start timing is point in time T1802).

Point in time T1801 is decided by performing the correction such that the voltage cutoff start timing of the fuel injection valve having a relatively short valve closing time and a long valve opening time is advanced with the voltage cutoff start timing at point in time T1802 as a reference. Point in time T1803 is decided by performing the correction such that the voltage cutoff start timing of the fuel injection valve having a relatively long valve closing time and a short valve opening time is delayed with the voltage cutoff start timing at time T1802 as a reference.

As stated above, the correction for setting the voltage cutoff end timings to be the same is performed by changing the voltage cutoff start timing, and thus, an excessive rising speed (valve opening speed) of the valve body 402 can be suppressed for the fuel injection valve having a relatively weak spring force of the set spring 408. The excessive rising speed (valve opening speed) of the valve body 402 can be suppressed for the fuel injection valve having a relatively strong spring force of the set spring 408.

As a result, the injection amount characteristics of the fuel injection valve having a relatively weak spring force of the set spring 408 can approach the injection amount characteristics of the fuel injection valve as the reference. The fuel injection valve having a relatively weak spring force of the set spring 408 has a longer valve closing time and a shorter valve opening time than the fuel injection valve as the reference. Accordingly, the injection amount characteristics of the fuel injection valve having a long valve closing time and a short valve opening time in the half lift region can be (approach) the injection amount characteristics of the fuel injection valve having a short valve closing time and a long valve opening time in the half lift region.

The injection amount characteristics of the fuel injection valve having a relatively strong spring force of the set spring 408 can approach the injection amount characteristics of the fuel injection valve as the reference. The fuel injection valve having a relatively strong spring force of the set spring 408 has a shorter valve closing time and a longer valve opening time than the fuel injection valve as the reference. Accordingly, the injection amount characteristics of the fuel injection valve having a short valve closing time and a long valve opening time in the half lift region can be (approach) the injection amount characteristics of the fuel injection valve having a long valve closing time and a short valve opening time in the half lift region. As a result, it is possible to reduce the variations in the injection amounts of the three fuel injection valves.

As described above, the boosted voltage supply time can be corrected by correcting the voltage cutoff start timing. Accordingly, a period from a timing at which the injection pulse is turned on (point in time T1821) to the voltage cutoff end timing (point in time T1811) may be used as the period in which the fuel injection is performed.

It can be said that the correction for setting the voltage cutoff end timing to be the same by changing the voltage cutoff start timing described above is a correction for changing a time in which the high voltage 202 and the battery voltage 209 are cut off for the solenoid 407 of the fuel injection valve.

The boosted voltage supply time, the voltage cutoff end timing, or the voltage cutoff start timing, and the holding current described above can be changed according to a fuel pressure value applied to the fuel injection valve 105. Since the fuel pressure value acts as a force to push the valve body 402 in the valve closing direction, as the fuel pressure becomes higher, the force for urging the valve body 402 in the valve closing direction becomes stronger. Thus, the spring force of the set spring 408 described so far is replaced with the fuel pressure value, and thus, the boosted voltage supply time, the voltage cutoff end timing, or the pressure cutoff start timing, and the holding current can be corrected with respect to the fuel pressure value.

For example, the fuel injection valve of which the fuel pressure value is smaller than a predetermined value has a longer valve closing time and a shorter valve opening time than the fuel injection valve of which the fuel pressure value is the predetermined value. Thus, the voltage cutoff end timing of the fuel injection valve of which the fuel pressure value is smaller than the predetermined value is set to be later than the voltage cutoff end timing of the fuel injection valve of which the fuel pressure value is the predetermined value (the same drive voltage and drive current as in FIG. 14).

Accordingly, it is possible to relatively reduce the rising speed of the valve body 402 in the fuel injection valve of which the fuel pressure value is smaller than the predetermined value, and it is possible to delay the rise of the magnetic attraction force due to the holding current. As a result, the timing at which the valve body 402 is reaccelerated in the valve opening direction can be delayed, and the injection amount characteristics of the fuel injection valve of which the fuel pressure value is smaller than the predetermined value can approach the injection amount characteristics of the fuel injection valve of which the fuel pressure value is the predetermined value.

The holding current of the fuel injection valve of which the fuel pressure value is smaller than the predetermined value is set to a value larger than the holding current of the fuel injection valve of which the fuel pressure value is the predetermined value, and the rise (movement in the valve opening direction) of the valve body 402 is encouraged. Accordingly, the rise (movement in the valve opening direction) of the valve body 402 in the fuel injection valve of which the fuel pressure value is smaller than the predetermined value can be encouraged, and the rising speed can be prevented from becoming too slow. As a result, the injection amount characteristics of the fuel injection valve of which the fuel pressure value is smaller than the predetermined value can be matched with (further approach) the injection amount characteristics of the fuel injection valve of which the fuel pressure value is the predetermined value (becoming the same injection amount characteristics as in FIG. 15).

[Conclusion]

As described above, the fuel injection control device (fuel injection control device 127) according to the aforementioned embodiment includes the control unit (fuel injection drive waveform instruction unit 202) that controls the voltages applied to the coils (solenoid 407) of the plurality of fuel injection valves (fuel injection valves 105), the coils being adapted for energization. The control unit performs control such that the voltage (high voltage 210) being applied to the coil is cut off. The control unit changes the timing at which the cutoff of the voltage to the coil of at least one fuel in injection valve is started (voltage cutoff start timing (point in time T1801)) or the timing at which the cutoff of the voltage to the coil of at least one fuel injection valve is ended (voltage cutoff end timing (point in time T1402)), based on the valve closing time (valve closing time 714) or the valve opening time (valve opening time 713).

Accordingly, the injection amount characteristics (injection amount characteristics 1502) of at least one fuel injection valve can be changed, and can be matched with the injection amount characteristics (injection amount characteristics 1501) of another fuel injection valve (see FIG. 15). As a result, it is possible to reduce the variations in the injection amounts, and the linearity of the injection amount characteristics is also improved. Accordingly, controllability of the fuel injection valves is improved.

The control unit of the fuel injection control device according to the aforementioned embodiment sets the timing at which the cutoff of the voltage to the coil of the fuel injection valve of which the valve closing time is longer than a predetermined time is ended (point in time T1402) to be later than the timing at which the cutoff of the voltage to the coil of the fuel injection valve of which the valve closing time is the predetermined time is ended (point in time T1401) (see FIG. 14).

In other words, the control unit sets the timing at which the cutoff of the voltage to the coil of the fuel injection valve of which the valve opening time is shorter than a specific time is ended (point in time T1402) to be later than the timing at which the cutoff of the voltage to the coil of the fuel injection valve of which the valve opening time is the specific time is ended (point in time T1401).

Accordingly, it is possible to relatively reduce the rising speed of the valve body 402 of the fuel injection valve having a long valve closing time and a short valve opening time, and it is possible to delay the rise of the magnetic attraction force due to the holding current. As a result, the timing at which the valve body 402 is reaccelerated in the valve opening direction can be delayed. Accordingly, the injection amount characteristics of the fuel injection valve having a long valve closing time and a short valve opening time can approach the injection amount characteristics of the fuel injection valve having a short valve closing time and a long valve opening time.

The control unit of the fuel injection control device according to the aforementioned embodiment changes the magnitude of the holding current flowing applying the low voltage lower than the voltage to the coil after the cut off of the voltage. That is, the control unit sets the value of the holding current (holding current 1412) flowing through the coil of the fuel injection valve of which the valve closing time is longer than the predetermined time to be larger than the value of the holding current (holding current 1411) flowing through the coil of the fuel injection valve of which the valve closing time is the predetermined time (see FIG. 14).

In other words, the control unit sets the value of the holding current (holding current 1412) flowing through the coil of the fuel injection valve of which the valve opening time is shorter than the specific time to be larger than the value of the holding current (holding current 1411) flowing through the coil of the fuel injection valve of which the valve closing time is the specific time.

Accordingly, the valve body 402 can be encouraged to rise (move in the valve opening direction) in the fuel injection valve having a long valve closing time and a short valve opening time, and the rising speed can be prevented from becoming too slow. That is, the valve opening time can be prevented from becoming too late. Accordingly, the injection amount characteristics (injection amount characteristics 1502) of the fuel injection valve having a long valve closing time and a short valve opening time can further approach the injection amount characteristics (injection amount characteristics 1501) of the fuel injection valve having a short valve closing time and a long valve closing time (see FIG. 15).

The control unit of the fuel injection control device according to the aforementioned embodiment sets the timing at which the cutoff of the voltage to the coil of the fuel injection valve of which the valve closing time is longer than the predetermined time is started (point in time T1803) to be later than the timing at which the cutoff of the voltage to the coil of the fuel injection valve of which the valve closing time is the predetermined time is started (point in time T1802). The control unit sets the timing at which the cutoff of the voltage to the coil of the fuel injection valve of which the valve closing time is longer than the predetermined time is ended (point in time 11811) to be the same as the timing at which the cutoff of the voltage to the coil of the fuel injection valve of which the valve closing time is the predetermined time is ended (point in time 11811).

In other words, the control unit sets the timing at which the cutoff of the voltage to the coil of the fuel injection valve of which the valve opening time is shorter than the specific time is started (point in time 11803) to be later than the timing at which the cutoff of the voltage to the coil of the fuel injection valve of which the valve opening time is the specific time is started (point in time 11802). The control unit sets the timing at which the cutoff of the voltage to the coil of the fuel injection valve of which the valve opening time is shorter than the specific time is ended (point in time T1811) to be the same as the timing at which the cutoff of the voltage to the coil of the fuel injection valve of which the valve opening time is the specific time is ended (point in time 11811).

Accordingly, the injection amount characteristics of the fuel injection valve having a long valve closing time and a short valve opening time can approach the injection amount characteristics of the fuel injection valve having a short valve closing time and a long valve opening time. As a result, it is possible to reduce the variations in the injection amounts of the plurality of fuel injection valves.

The control unit of the fuel injection control device according to the aforementioned embodiment sets the timing at which the cutoff of the voltage to the coil of the fuel injection valve of which the valve closing time is shorter than the predetermined time is ended to be earlier than the timing at which the cutoff of the voltage to the coil of the fuel injection valve of which the valve closing time is the predetermined time is ended.

In other words, the control unit sets the timing at which the cutoff of the voltage to the coil of the fuel injection valve of which the valve opening time is longer than the specific time is ended to be earlier than the timing at which the cutoff of the voltage to the coil of the fuel injection valve of which the valve opening time is the specific time is ended.

Accordingly, it is possible to relatively increase the rising speed of the valve body 402 of the fuel injection valve having a short valve closing time and a long valve opening time, and it is possible to accelerate the rise of the magnetic attraction force due to the holding current. As a result, the timing at which the valve body 402 is reaccelerated in the valve opening direction can be accelerated. Accordingly, the injection amount characteristics of the fuel injection valve having a short valve closing time and a long valve opening time can approach the injection amount characteristics of the fuel injection valve having a long valve closing time and a short valve opening time.

The control unit of the fuel injection control device according to the aforementioned embodiment changes the magnitude of the holding current flowing by applying the low voltage lower than the voltage to the coil after the cut off of the voltage. That is, the control unit sets the value of the holding current flowing through the coil of the fuel injection valve of which the valve opening time is shorter than the predetermined time to be smaller than the value of the holding current flowing through the coil of the fuel injection valve of which the valve closing time is the predetermined time.

Accordingly, the rise of the valve body 402 (movement in the valve opening direction) in the fuel injection valve having a short valve closing time and a long valve opening time can be suppressed, and the rising speed can be prevented from becoming too fast. That is, the valve opening time can be prevented from becoming too early. Accordingly, the injection amount characteristics (injection amount characteristics 1601) of the fuel injection valve having a short valve closing time and a long valve opening time can further approach the injection amount characteristics (injection amount characteristics 1602) of the fuel injection valve having a long valve closing time and a short valve closing time (see FIG. 16).

The control unit of the fuel injection control device according to the aforementioned embodiment sets the timing at which the cutoff of the voltage to the coil of the fuel injection valve of which the valve closing time is shorter than the predetermined time is started (point in time T1801) to be earlier than the timing at which the cutoff of the voltage to the coil of the fuel injection valve of which the valve closing time is the predetermined time is started (point in time T1802). The control unit sets the timing at which the cutoff of the voltage to the coil of the fuel injection valve of which the valve closing time is shorter than the predetermined time is ended (point in time 71811) to be the same as the timing at which the cutoff of the voltage to the coil of the fuel injection valve of which the valve closing time is the predetermined time is ended (point in time T1811).

In other words, the control unit sets the timing at which the cutoff of the voltage to the coil of the fuel injection valve of which the valve opening time is longer than the specific time (point in time T1801) to be earlier than the timing at which the cutoff of the voltage to the coil of the fuel injection valve of which the valve opening time is the specific time (pint in time T1802). The control unit sets the timing at which the cutoff of the voltage to the coil of the fuel injection valve of which the valve opening time is longer than the specific time is ended (point in time 71811) to be the same as the timing at which the cutoff of the voltage to the coil of the fuel injection valve of which the valve opening time is the specific time is ended (point in time T1811).

Accordingly, the injection amount characteristics of the fuel injection valve having a short valve closing time and a long valve opening time (of which the valve opening time is longer than the specific time) can approach the injection amount characteristics of the fuel injection valve having a long valve closing time and a short valve opening time (of which the valve opening time is the specific time). As a result, it is possible to reduce the variations in the injection amounts of the plurality of fuel injection valves.

The control unit of the fuel injection control device according to the aforementioned embodiment changes the application time of the voltage or the current value flowing by applying the voltage according to the timing at which the cutoff of the voltage is started.

Accordingly, for example, the application time of the high voltage 210 is increased for the fuel injection valve having a shorter valve closing time and a longer valve opening time than the fuel injection valve as the reference such that the valve opening time becomes short, and thus, the current value flowing through the solenoid 407 can be increased. As a result, the magnetic attraction force acting on the movable core 403 becomes large, and the valve opening time of the fuel injection valve having a shorter valve closing time and a longer valve opening time than the fuel injection valve as the reference can approach the valve opening time of the fuel injection valve as the reference.

The control unit of the fuel injection control device according to the aforementioned embodiment changes the magnitude of the holding current flowing by applying the low voltage lower than the voltage to the coil after the cut off of the voltage. That is, the control unit sets the timing at which the cutoff of the voltage to the coil of the fuel injection valve of which the fuel pressure value is smaller than the predetermined value is ended to be later than the timing at which the cutoff of the voltage to the coil of the fuel injection valve of which the fuel pressure value is the predetermined value is ended. The control unit sets the value of the holding current flowing through the coil of the fuel injection valve of which the fuel pressure value is smaller than the predetermined value to be larger than the value of the holding current flowing through the coil of the fuel injection valve of which the fuel pressure value is the predetermined value.

Accordingly, in the fuel injection valve of which the fuel pressure value is smaller than the predetermined value, the rise of the magnetic attraction force due to the holding current is delayed, and thus, the injection amount characteristics of the fuel injection valve of which the fuel pressure value is smaller than the predetermined value can approach the injection amount characteristics of the fuel injection valve of which the fuel pressure value is the predetermined value. The rising speed of the valve body 402 in the fuel injection valve of which the fuel pressure value is smaller than the predetermined value can be prevented from becoming too slow. As a result, the injection amount characteristics of the fuel injection valve of which the fuel pressure value is smaller than the predetermined value can be matched with (further approach) the injection amount characteristics of the fuel injection valve of which the fuel pressure value is the predetermined value.

The fuel injection control device (fuel injection control device 127) according to the aforementioned embodiment includes the control unit (fuel injection drive waveform instruction unit 202) that controls the voltages applied to the coils (solenoid 407) of the plurality of fuel injection valves (fuel injection valves 105), the coils being adapted for energization. The control unit performs control such that the voltage (high voltage 210) being applied to the coil is cut off. The control unit changes the time in which the voltage to the coil of at least one fuel injection valve is cut off based on the valve closing time (valve closing time 714) or the valve opening time (valve opening time 713).

Accordingly, the injection amount characteristics (injection amount characteristics 1502) of at least one fuel injection valve can be changed, and can be matched with the injection amount characteristics (injection amount characteristics 1501) of another fuel injection valve (see FIG. 15). As a result, it is possible to reduce the variations in the injection amounts, and the linearity of the injection amount characteristics is also improved. Accordingly, controllability of the fuel injection valves is improved.

The embodiment of the fuel injection control device of the present invention has been described above including the actions and effects. However, the fuel injection control device of the present invention is not limited to the above-described embodiment, and various modification examples can be made without departing from the gist of the invention described in the claims.

The aforementioned embodiment is described in detail in order to facilitate easy understanding of the present invention, and is not limited to necessarily include all the described components. Some of the components of a certain embodiment can be substituted into the components of another embodiment, and the components of another embodiment can be added to the component of a certain embodiment. In addition, other components can be added, removed, and substituted to, from, and into some of the components of the aforementioned embodiment.

For example, in the aforementioned embodiment, an example in which the voltage cutoff start timing and the voltage cutoff end timing in the half lift control are changed and an example in which the value of the holding current is changed have been described. However, the reduction of the variations in the injection amounts by changing the voltage cutoff start timing, the voltage cutoff end timing, and the value of the holding current according to the present invention can also be applied to the full lift control.

REFERENCE SIGNS LIST

101 internal combustion engine
102 piston
103 intake valve
104 exhaust valve
105 fuel injection valve
106 ignition plug
107 Ignition coil
108 water temperature sensor
109 ECU
110 intake pipe

111 exhaust pipe
112 three-way catalyst
113 oxygen sensor
115 collector
116 crank angle sensor
119 throttle valve
120 air flow meter
121 combustion chamber
122 accelerator opening sensor
123 fuel tank
124 low-pressure fuel pump
125 high-pressure fuel pump
126 fuel pressure sensor
127 fuel injection control device
128 exhaust cam
129 high-pressure fuel pipe
131 crankshaft
132 connecting rod
201 fuel injection pulse signal calculation unit
202 fuel injection drive waveform instruction unit
203 engine state detection unit:
204 fuse
205 relay
206 high voltage generation unit
207*a*, 207*b* fuel injection drive unit
208 drive IC
209 battery voltage
210 high voltage (power supply voltage)
211 valve body operating time detection unit
212 drive current correction amount calculation unit
301, 302 diode
303 high voltage side switching element
304 low voltage side switching element
305 switching element
306 shunt resistor
401 housing
402 valve body
402*a* distal end portion
402*b* rear end portion
403 movable core
403*a* through-hole
404 fixed core
405 valve seat
406 injection hole
407 solenoid
408 set spring
409 zero spring
711, 712 inflection point
713 valve opening time
714 valve closing time

The invention claimed is:

1. A fuel injection control device comprising a control unit that controls voltages applied to coils of a plurality of fuel injection valves, the coils being adapted for energization, wherein the control unit performs control such that the voltage being applied to the coil is cut off, and changes a timing at which the cutoff of the voltage to the coil of at least one fuel injection valve is started or a timing at which the cutoff of the voltage to the coil of at least one fuel injection valve is ended, based on a valve closing time from when energization to the fuel injection valve is stopped to when closing of the fuel injection valve is completed or a valve opening time from when the energization to the fuel injection valve is started to when opening of the fuel injection valve is completed, sets the timing at which the cutoff of the voltage to the coil of the fuel injection valve of which the valve opening time is shorter than a specific time is ended to be later than the timing at which the cutoff of the voltage to the coil of the fuel injection valve of which the valve opening time is the specific time is ended, changes a magnitude of a holding current flowing by applying a low voltage lower than the voltage to the coil after the cut off of the voltage, and sets a valve of the holding current flowing through the coil of the fuel injection valve of which the valve opening time is shorter than the specific time to be larger than a value of the holding current flowing through the coil of the fuel injection valve of which the valve closing time is the specific time.

2. The fuel injection control device according to claim 1, wherein the control unit sets the timing at which the cutoff of the voltage to the coil of the fuel injection valve to be later than the timing at which the cutoff of the voltage to the coil of the fuel injection valve is ended.

3. The fuel injection control device according to claim 2, wherein the control unit changes a magnitude of a holding current flowing by applying a low voltage lower than the voltage to the coil after the cut off of the voltage, and sets a value of the holding current flowing through the coil of the fuel injection valve of which the valve closing time is longer than the predetermined time to be larger than a value of the holding current flowing through the coil of the fuel injection valve of which the valve closing time is the predetermined time.

4. The fuel injection control device according to claim 1, wherein the control unit sets the timing at which the cutoff of the voltage to the coil of the fuel injection valve of which the valve closing time is longer than a predetermined time is started to be later than the timing at which the cutoff of the voltage to the coil of the fuel injection valve of which the valve closing time is the predetermined time is started, and sets the timing at which the cutoff of the voltage to the coil of the fuel injection valve of which the valve closing time is longer than the predetermined time is ended to be the same as the timing at which the cutoff of the voltage to the coil of the fuel injection valve of which the valve closing time is the predetermined time is ended.

5. The fuel injection control device according to claim 1, wherein the control unit sets the timing at which the cutoff of the voltage to the coil of the fuel injection valve of which the valve opening time is shorter than a specific time is started to be later than the timing at which the cutoff of the voltage to the coil of the fuel injection valve of which the valve opening time is the specific time is started, and sets the timing at which the cutoff of the voltage to the coil of the fuel injection valve of which the valve opening time is shorter than the specific time is ended to be the same as the timing at which the cutoff of the voltage to the coil of the fuel injection valve of which the valve opening time is the specific time is ended.

6. The fuel injection control device according to claim 1, wherein the control unit sets the timing at which the cutoff of the voltage to the coil of the fuel injection valve of which the valve closing time is shorter than a predetermined time is ended to be earlier than the timing at which the cutoff of the voltage to the coil of the fuel injection valve of which the valve closing time is the predetermined time is ended.

7. The fuel injection control device according to claim 6, wherein the control unit changes a magnitude of a holding current flowing by applying a low voltage lower than the voltage to the coil after the cut off of the voltage, and sets a value of the holding current flowing through the coil of the fuel injection valve of which the valve opening time is shorter than the predetermined time to be smaller than a value of the holding current flowing through the coil of the fuel injection valve of which the valve closing time is the predetermined time.

8. The fuel injection control device according to claim 1, wherein the control unit sets the timing at which the cutoff of the voltage to the coil of the fuel injection valve of which the valve closing time is shorter than a predetermined time is started to be earlier than the timing at which the cutoff of the voltage to the coil of the fuel injection valve of which the valve closing time is the predetermined time is started, and sets the timing at which the cutoff of the voltage to the coil of the fuel injection valve of which the valve closing time is shorter than the predetermined time is ended to be the same as the timing at which the cutoff of the voltage to the coil of the fuel injection valve of which the valve closing time is the predetermined time is ended.

9. The fuel injection control device according to claim 1, wherein the control unit sets the timing at which the cutoff of the voltage to the coil of the fuel injection valve of which the valve opening time is longer than a specific time is ended to be earlier than the timing at which the cutoff of the voltage to the coil of the fuel injection valve of which the valve opening time is the specific time is ended.

10. The fuel injection control device according to claim 9, wherein the control unit changes a magnitude of a holding current flowing by applying a low voltage lower than the voltage to the coil after the cut off of the voltage, and sets a value of the holding current flowing through the coil of the fuel injection valve of which the valve closing time is longer than the specific time to be smaller than a value of the holding current flowing through the coil of the fuel injection valve of which the valve closing time is the specific time.

11. The fuel injection control device according to claim 1, wherein the control unit sets the timing at which the cutoff of the voltage to the coil of the fuel injection valve of which the valve opening time is longer than a specific time is started to be earlier than the timing at which the cutoff of the voltage to the coil of the fuel injection valve of which the valve opening time is the specific time is started, and sets the timing at which the cutoff of the voltage to the coil of the fuel injection valve of which the valve opening time is longer than the specific time is ended to be the same as the timing at which the cutoff of the voltage to the coil of the fuel injection valve of which the valve opening time is the specific time is ended.

12. The fuel injection control device according to claim 1, wherein the control unit changes an application time of the voltage or a current value flowing by applying the voltage according to the timing at which the cutoff of the voltage is started.

13. The fuel injection control device according to claim 1, wherein the control unit changes a magnitude of a holding current flowing by applying a low voltage lower than the voltage to the coil after the cut off of the voltage, sets the timing at which the cutoff of the voltage to the coil of the fuel injection valve of which a fuel pressure value is smaller than a predetermined value is ended to be later than the timing at which the cutoff of the voltage to the coil of the fuel injection valve of which the fuel pressure value is the predetermined valve is ended, and sets a value of the holding current flowing through the coil of the fuel injection valve of which the fuel pressure value is smaller than the predetermined valve to be larger than a value of the holding current flowing through the coil of the fuel injection valve of which the fuel pressure value is the predetermined value.

* * * * *